US011359878B2

(12) United States Patent
Moretti

(10) Patent No.: US 11,359,878 B2
(45) Date of Patent: Jun. 14, 2022

(54) TRIGGER UNIT FOR A FIREARM

(71) Applicant: BENELLI ARMI S.p.A, Urbino (IT)

(72) Inventor: Luigi Moretti, Collebeato (IT)

(73) Assignee: BENELLI ARMI S.P.A., Urbino (IT)

( * ) Notice: Subject to any disclaimer, the term of this patent is extended or adjusted under 35 U.S.C. 154(b) by 73 days.

(21) Appl. No.: 16/891,191

(22) Filed: Jun. 3, 2020

(65) Prior Publication Data

US 2020/0386503 A1 Dec. 10, 2020

(30) Foreign Application Priority Data

Jun. 4, 2019 (IT) ..... 102019000007983

(51) Int. Cl.
*F41A 19/15* (2006.01)
*F41A 17/46* (2006.01)
*F41A 19/16* (2006.01)

(52) U.S. Cl.
CPC ..... *F41A 19/15* (2013.01); *F41A 17/46* (2013.01); *F41A 19/16* (2013.01)

(58) Field of Classification Search
CPC ..... F41A 19/15; F41A 17/46; F41A 19/16
USPC ..... 42/69.01, 69.02
See application file for complete search history.

(56) References Cited

U.S. PATENT DOCUMENTS 3,707,796 A * 1/1973 Bielfeldt ..... F41A 17/56 42/70.04
4,305,218 A 12/1981 Godsey
4,516,466 A 5/1985 Jennie
4,625,444 A * 12/1986 Beretta ..... F41A 19/17 42/69.02
4,671,005 A * 6/1987 Jewell ..... F41A 19/31 42/DIG. 1
4,754,567 A * 7/1988 Lehfeldt ..... F41A 19/17 42/69.01
5,615,507 A * 4/1997 French ..... F41A 17/56 42/69.02
6,722,072 B1 * 4/2004 McCormick ..... F41A 19/10 42/69.03
8,220,193 B1 * 7/2012 Lynch ..... F41A 17/82 42/70.08
8,966,802 B1 * 3/2015 Findlay ..... F41A 19/12 42/69.01
9,046,313 B1 * 6/2015 Lutton ..... F41A 19/44
9,097,485 B2 * 8/2015 Lipowski ..... F41A 19/10
10,731,937 B2 * 8/2020 Schacht ..... F41A 19/10
10,976,124 B2 * 4/2021 Kolev ..... F41A 19/10
2001/0039751 A1 * 11/2001 Kurvinen ..... F41A 33/00 42/69.01
2005/0183311 A1 * 8/2005 Diaz ..... F41A 19/16 42/69.01

(Continued)

FOREIGN PATENT DOCUMENTS

DE 3028853 2/1982
RU 2583122 C2 5/2016

*Primary Examiner* — Joshua E Freeman
(74) *Attorney, Agent, or Firm* — Duane Morris LLP; Gregory M. Lefkowitz; Randall C. Pyles

(57) ABSTRACT

A trigger unit including a support adapted to be mounted on a receiver of a firearm and supporting components of a trigger mechanism and a safety system; the trigger unit is modular; the support includes a plurality of seats adapted to accommodate one or more different functional components in various combinations.

11 Claims, 30 Drawing Sheets

(56) References Cited

U.S. PATENT DOCUMENTS

| | | | | |
|---|---|---|---|---|
| 2009/0113777 | A1* | 5/2009 | Williams | F41A 19/17 42/69.01 |
| 2011/0277367 | A1* | 11/2011 | Krieger | F41A 19/16 42/69.01 |
| 2012/0090213 | A1* | 4/2012 | Pichler | F41A 17/46 42/70.06 |
| 2014/0311006 | A1* | 10/2014 | Kott | F41A 19/12 42/69.01 |
| 2015/0253094 | A1* | 9/2015 | Reynolds | F41A 19/10 42/69.01 |
| 2015/0316335 | A1* | 11/2015 | Withey | F41A 19/30 42/16 |
| 2016/0047615 | A1 | 2/2016 | Tubb | |
| 2016/0187091 | A1* | 6/2016 | Moretti | F41A 3/58 42/69.01 |
| 2016/0187092 | A1* | 6/2016 | Mather | F41A 3/66 42/69.02 |
| 2016/0282075 | A1* | 9/2016 | Colman | F41A 19/46 |
| 2017/0191776 | A1* | 7/2017 | Dextraze | F41A 19/12 |
| 2017/0299323 | A1* | 10/2017 | Nachefski | F41A 17/56 |
| 2018/0100712 | A1* | 4/2018 | Tompkins | F41A 11/00 |
| 2018/0202740 | A1* | 7/2018 | Elftmann, Jr. | F41A 19/15 |
| 2018/0252493 | A1* | 9/2018 | Heckert | F41B 11/648 |
| 2019/0368834 | A1* | 12/2019 | Schacht | F41A 19/14 |
| 2019/0368835 | A1* | 12/2019 | Schacht | F41A 19/14 |
| 2020/0041222 | A1* | 2/2020 | Lobert | F41A 19/17 |
| 2020/0064095 | A1* | 2/2020 | Geissele | F41A 19/10 |

* cited by examiner

TRIGGER UNIT FOR A FIREARM

The present invention relates to a trigger unit particularly studied for a bolt action carbine.

As is known, the trigger mechanism of a firearm can be provided in the form of a unit that can be extracted from the body of the firearm.

Trigger units are known which are mounted on a support that is known as trigger plate, which can be applied to the lower part of the firearm at an adapted opening or hollow.

Such a removable trigger mechanism normally includes a frame in which the trigger and the trigger system, composed of suitable levers which act on the firing pin of the firearm, are mounted.

It is known to provide various replaceable trigger units in a same firearm in order to give different functional properties to the trigger system according to the different requirements of the user.

US2016047615A1 discloses a drop-in adjustable trigger assembly having a camming safety linkage to selectively move and engage a bolt sear to positively prevent movement of the bolt sear. The drop-in trigger assembly housing carries a pivoting bolt sear engagement member which is connected to a sear safety linkage. The housing has a sear safety linkage slot defined therein which guides the pivoting sear safety linkage in response to actuation of an upwardly projecting thumb safety lever's actuation. A trigger bracket carries a removable, reversible trigger shoe and is configured to pivot within the housing about a pivot point within the housing, and the trigger bracket carries an adjustable rocker having a first stage movement adjustment and a second stage length adjustment. The pivoting safety mechanism's safety linkage pivots rearwardly to push upon or cam the bolt sear upwardly, thus disengaging the bolt sear from the trigger sear.

US2015316335A1 discloses a bolt action firearm that cocks the firing pin upon closing the bolt and has a cam pin with dual heads for a high velocity rimfire cartridge. Actuating the main spring while closing the bolt, instead of while opening the bolt, should uniformly distribute the physical energy required by the user over the bolt actuation cycle. The dual heads of the cam pin allegedly provide symmetric reactive forces with dual cam slots, thereby preventing the cam pin from skewing or canting within the cam slots.

DE3028853A1 discloses a trigger mechanism for shotguns having an adjustable spring pressure for pull and sensitivity plus electronic firing circuit. The trigger unit consists of a frame internal to the weapon, with two upright bearing flanges bored centrally to support a cross shaft about which the trigger element pivots. A cross bar fixed to the trigger element is supported between two arms formed in the trigger element body, the trigger itself being screwed to this cross bar. The trigger element is acted upon by a two bladed leaf spring, one blade of which has its free end under a bolt protruding from the element and holds the latter against an adjustable stop screw. The other end of the spring pushes against a vertical adjustable screw. The limit of travel when the trigger is pulled is governed by a further adjustable stop screw and stop cam. One end of the trigger element has a permanent magnet mounted on it, which completes an electric circuit when passing over a semiconductor I.C. and fires the weapon when the trigger is pulled. An additional pressure point can, also adjustable, allow easy frictionless action and improved sensitivity of trigger.

None of the available prior art firearm discloses a comprehensive modular system for the trigger unit.

The aim of the present invention is to provide a new trigger unit of the modular type so that it can be manufactured in various configurations in order to meet different requirements of users.

Within the scope of this aim, an object of the invention is to provide a trigger unit that can be manufactured at low cost.

Another object of the present invention is to provide a trigger unit which, by virtue of its particular constructive characteristics, is capable of giving the greatest assurances of reliability and safety in use.

This aim and these and other objects which will become better apparent hereinafter are achieved by a trigger unit including a support adapted to be mounted on a receiver of a firearm including a bolt and a firing pin that is inserted in the bolt, the support supporting the components of a trigger mechanism and of a safety system; the trigger unit being characterized in that the support includes a plurality of seats adapted to accommodate one or more different functional components.

Further characteristics and advantages will become better apparent from the description of preferred but not exclusive embodiments of the invention, illustrated by way of non-limiting example in the accompanying drawings, wherein.

Figure 1:
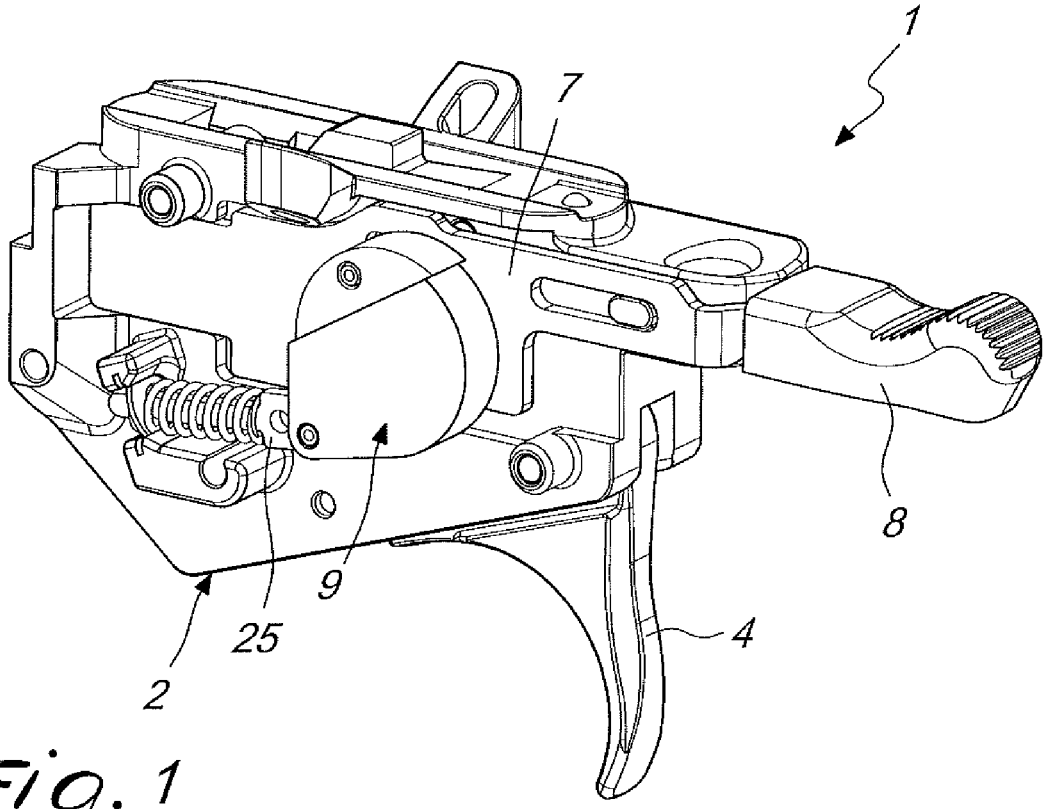
FIG. 1 is a perspective view of the trigger unit according to the present invention.
Figure 2:
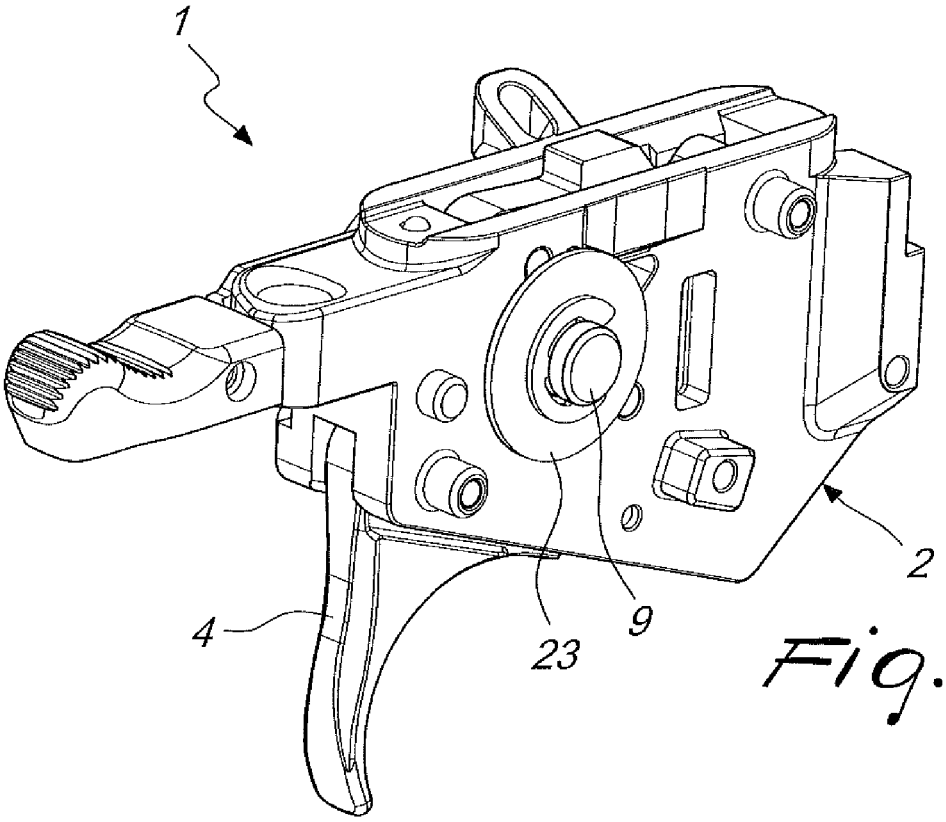
FIG. 2 is a perspective view of the opposite side of the trigger unit.
Figure 3:
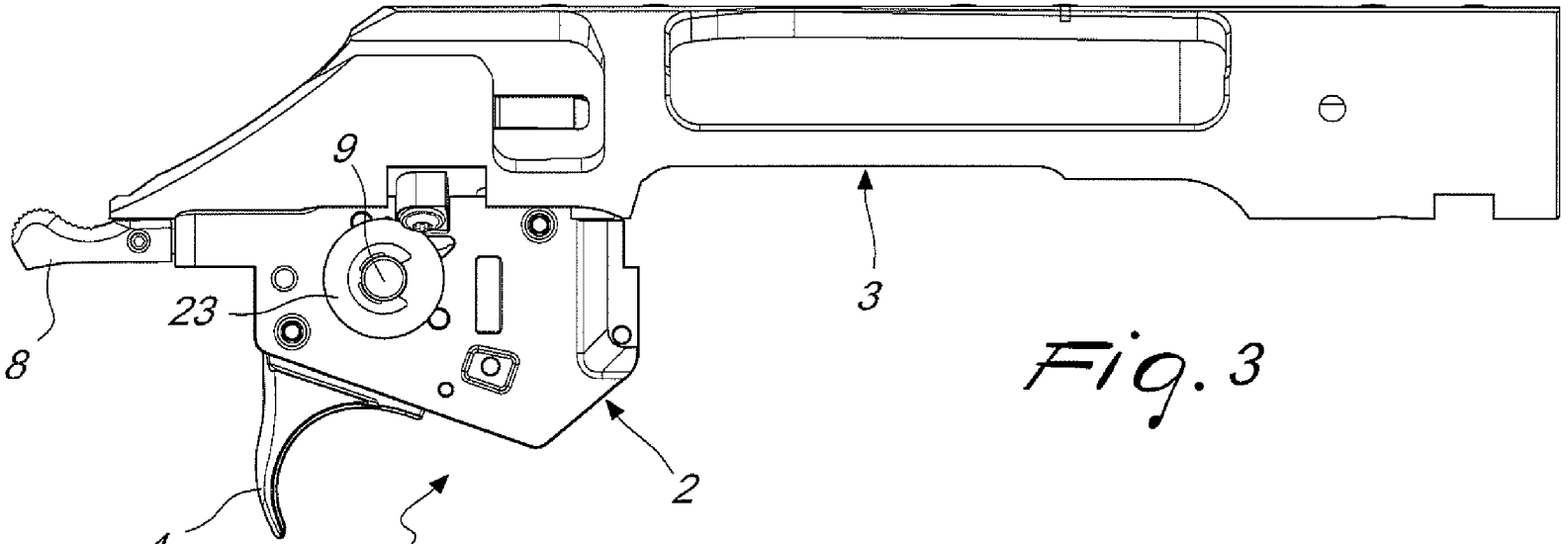
FIG. 3 is a side view of the trigger unit applied to the receiver of a right-handed firearm.
Figure 4:
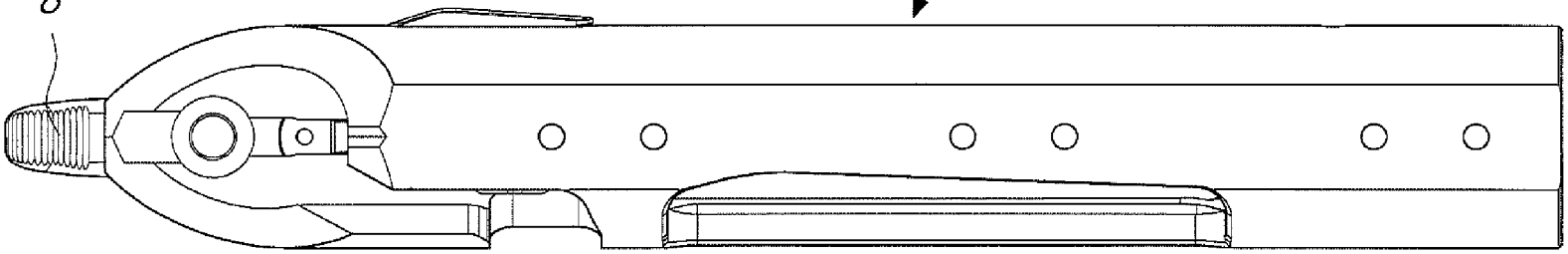
FIG. 4 is a plan view of the assembly of the preceding figure.
Figure 5:
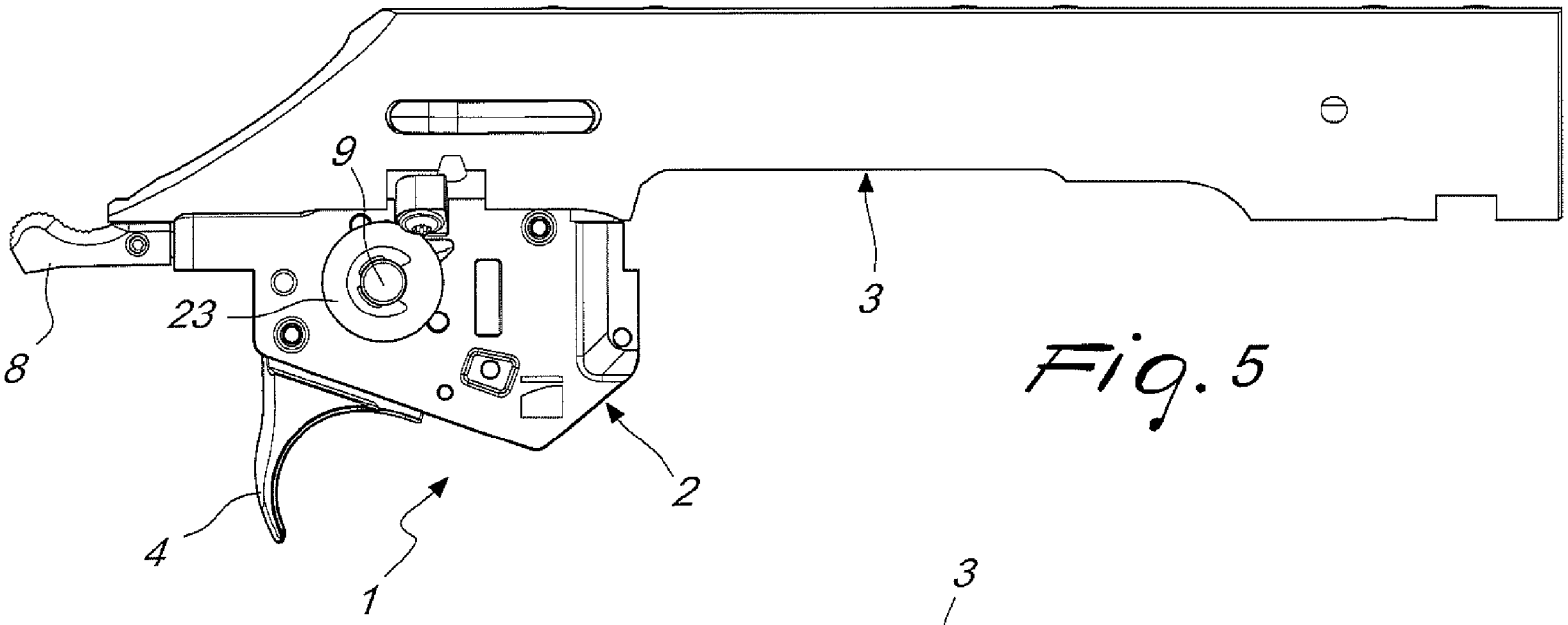
FIG. 5 is a side view of the trigger unit applied to the receiver of a left-handed firearm.
Figure 6:
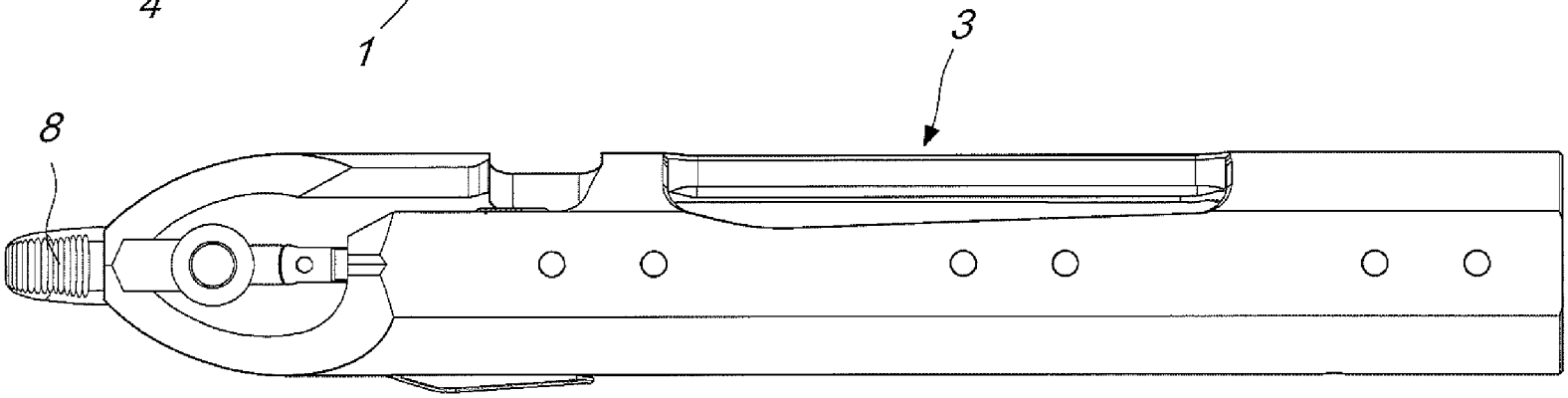
FIG. 6 is a plan view of the assembly of the preceding figure.
Figure 7:
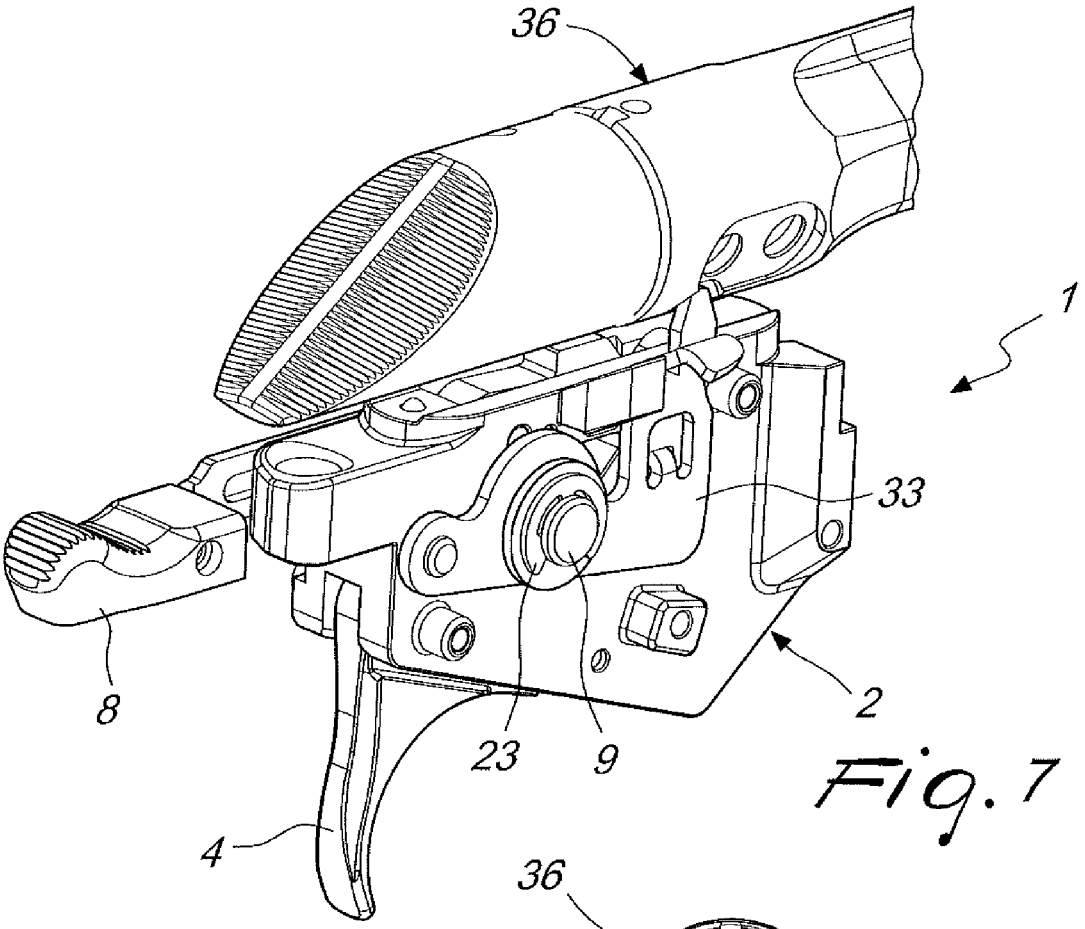
FIG. 7 is a perspective view of the trigger unit and of the bolt.
Figure 8:
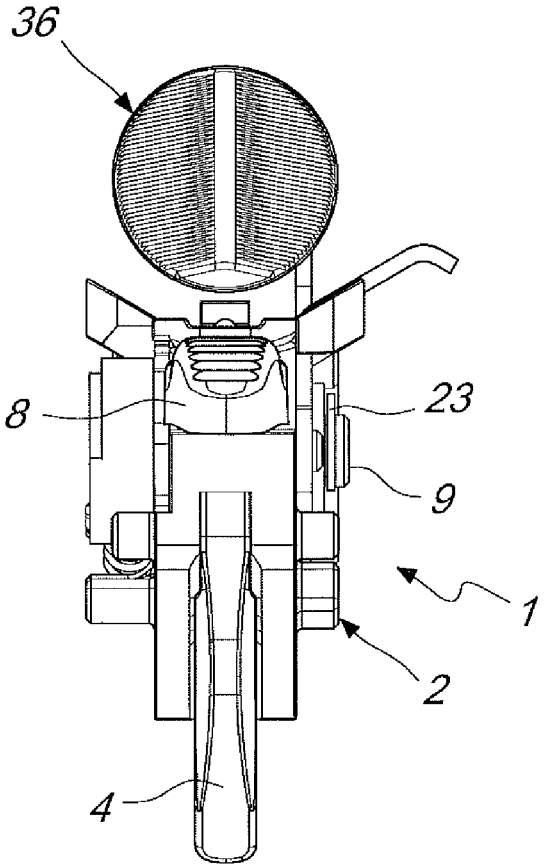
FIG. 8 is a rear view of the trigger unit and of the bolt.

With reference to the cited figures, the trigger unit according to the invention, generally designated by the reference numeral 1, has a support 2 adapted to be mounted in a receiver 3 of a right-handed or left-handed firearm.

The trigger unit is described hereinafter in an embodiment suitable for a bolt action carbine.

As is known, the term bolt action identifies a mechanism with a bolt that can rotate and slide to close the breech in manual repeating or single shot carbines or rifles.

In a bolt action firearm, the bolt moves manually at first by rotating it about its own axis and then retracting it to open the breech and expel the fired case and then, with an opposite movement, allowing the loading of another cartridge into the chamber, close the breech and make the firearm ready to fire.

The support 2 supports a trigger 4 and the corresponding components of the trigger mechanism, which include a trigger pull weight adjustment device, designated generally by the reference numeral 5.

The trigger pull weight adjustment device 5 is inserted in a seat 6 provided in the support 2.

The support 2 has a safety system which includes a plate 7, a button 8, and a selector 9, 109, 209, 309.

The support 2 has two seats 10 and 11 for an optional set trigger device.

The trigger unit according to the present invention is modular and is provided in various configurations in order to meet different requirements of the shooter.

Some main configurations are described hereinafter by way of nonlimiting indication.

According to a first configuration, with a simple safety and without a set trigger device, the trigger unit includes a trigger 4, which is pivoted to the support 2 by means of a pivot 12 and has a protrusion 13 adapted to interact with a lower protrusion 14 of a safety tooth 15 that is pivoted to the support 2.

FIGS. 9-20 show the main operating positions of the trigger unit in the version with simple safety and without set trigger device.

The safety tooth 15 has an upper end 16, which is in contact with the selector 9 and engages a reducer 17 which in turn is pivoted to the support 2.

The reducer 17 acts on a firing pin hook tooth 18, which interacts directly with the firing pin 19.

The safety tooth 15, the reducer 17 and the firing pin hook tooth 18 are the three components of the engagement system that allow to engage and release the firing pin 19.

The firing pin hook tooth 18, which interacts directly with the firing pin 19, is shaped so as to minimize both the striking time and the force that enters the trigger unit.

The reducer 17 has the task of further reducing the force that enters the unit and can be used to vary the trigger pull weight on the trigger 4.

The safety tooth 15, which is a fundamental component of the trigger, ensures a fluid, short and sharp trigger stroke and creates, with the reducer 17, a closed system of forces in order to increase the safety of the firearm.

Figure 9:
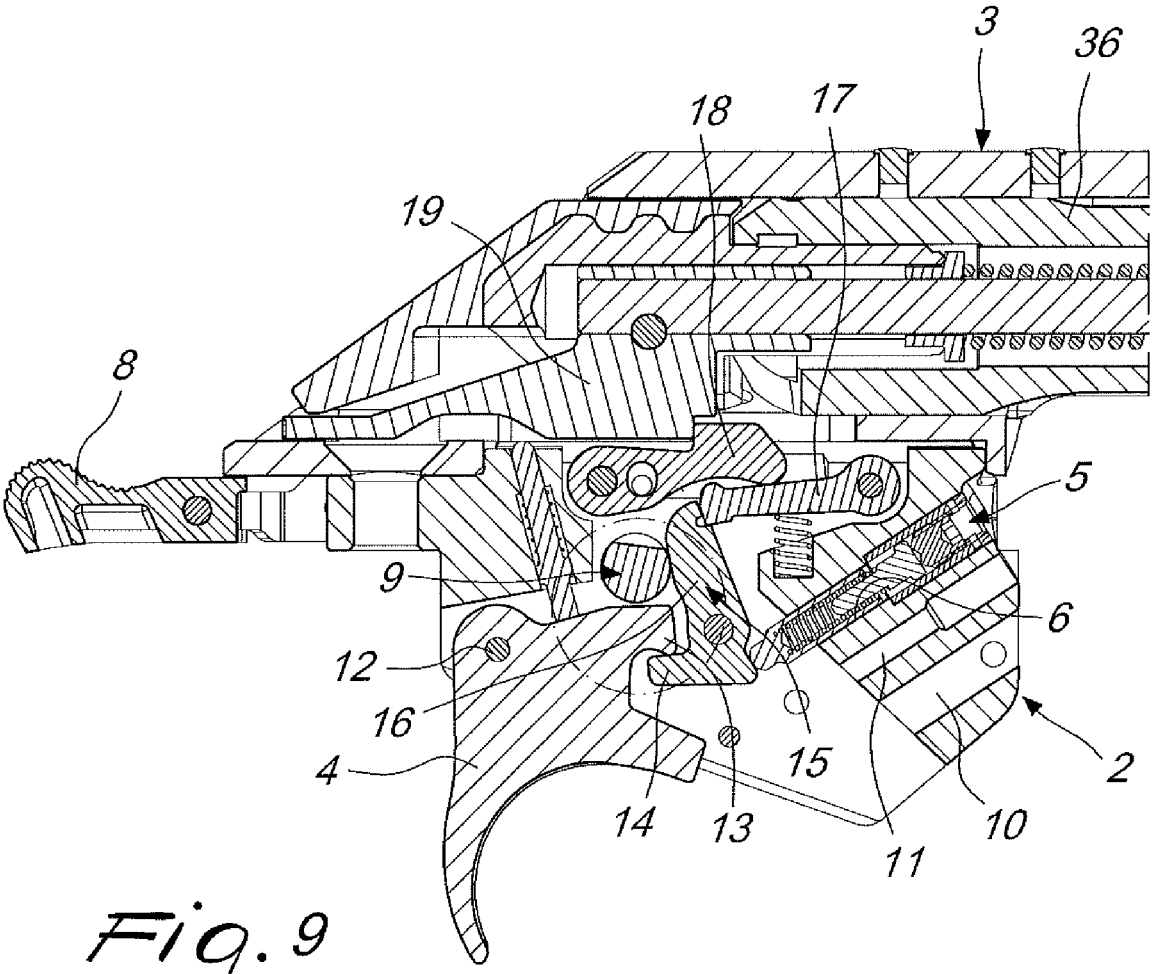
FIG. 9 is a section side view of the trigger unit and of part of the bolt and of the receiver of the firearm, shown in the firearm on safe position.
Figure 10:
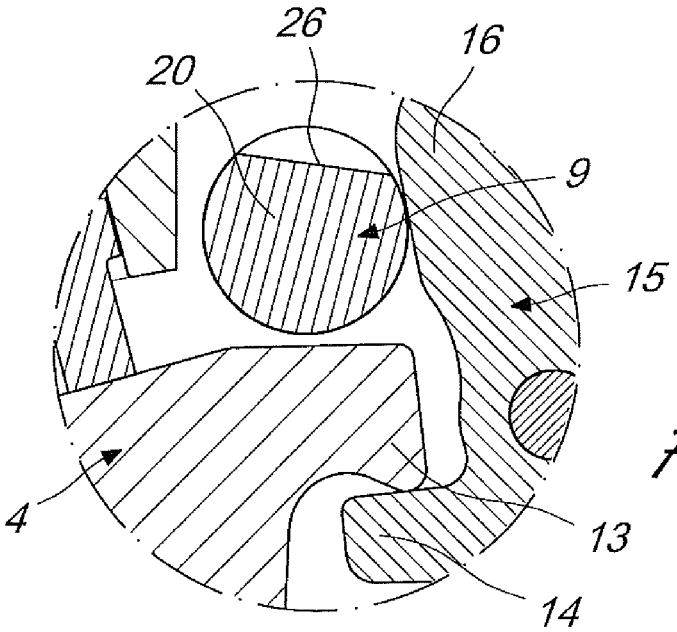
FIG. 10 is an enlarged view of a detail of FIG. 9.
Figure 11:
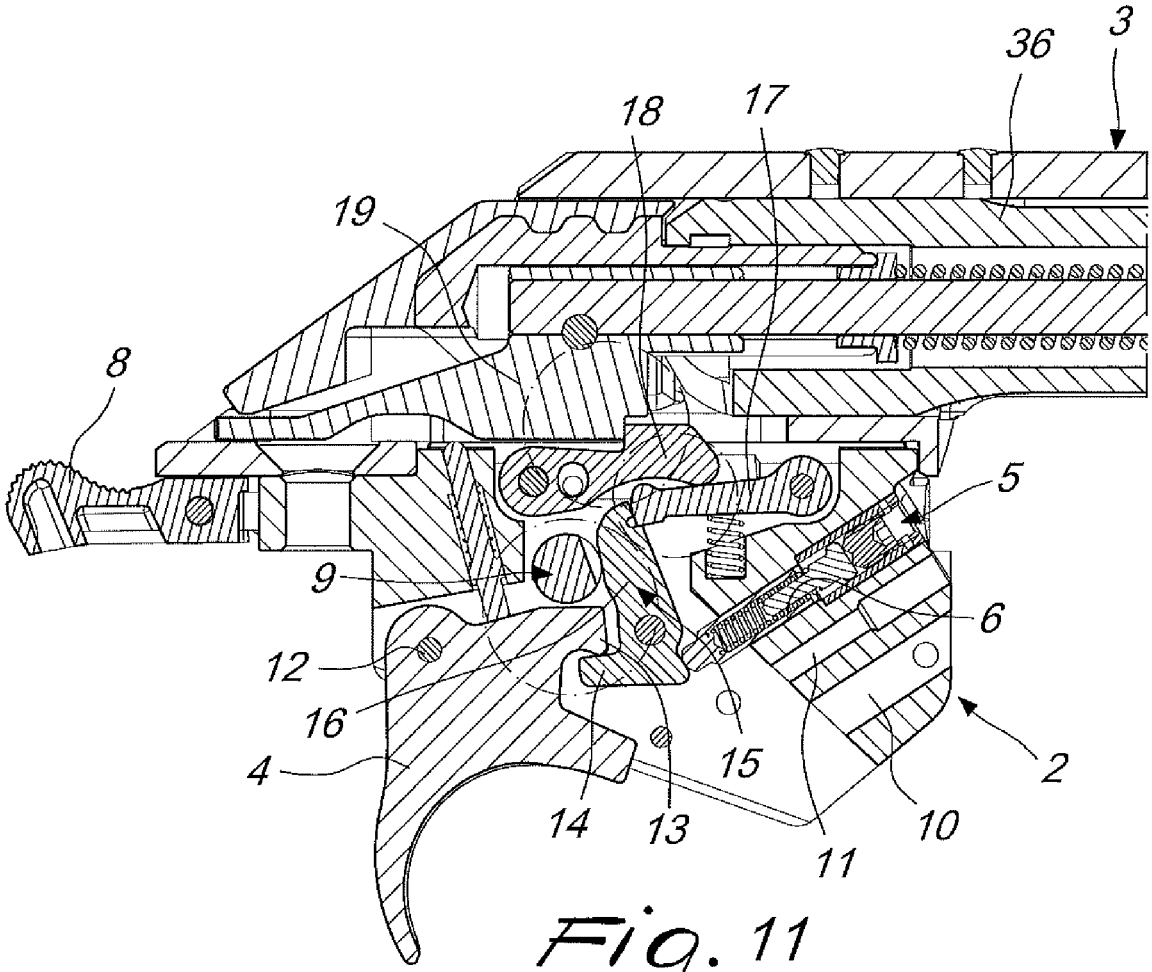
FIG. 11 is a section side view of the trigger unit and of part of the bolt and of the receiver of the firearm, shown in the firearm on fire position.
Figure 12:
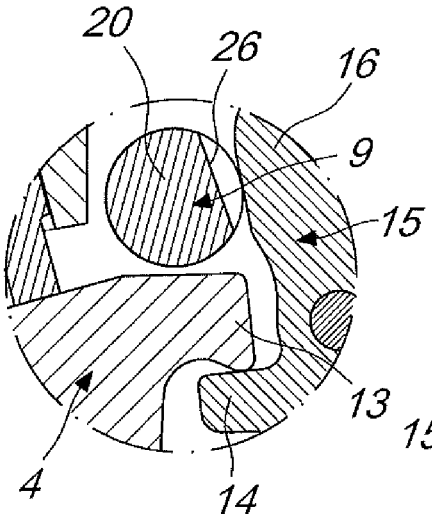
FIGS. 12-14 are enlarged views of details of FIG. 11.
Figure 13:
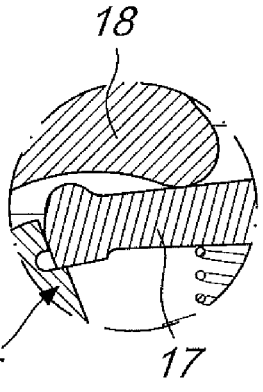
Figure 14:
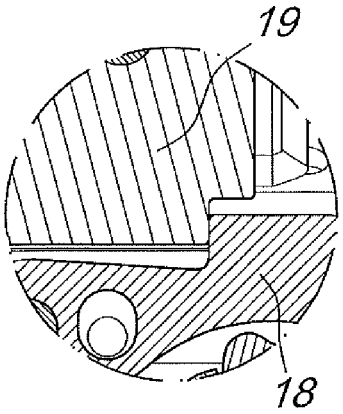
Figure 15:
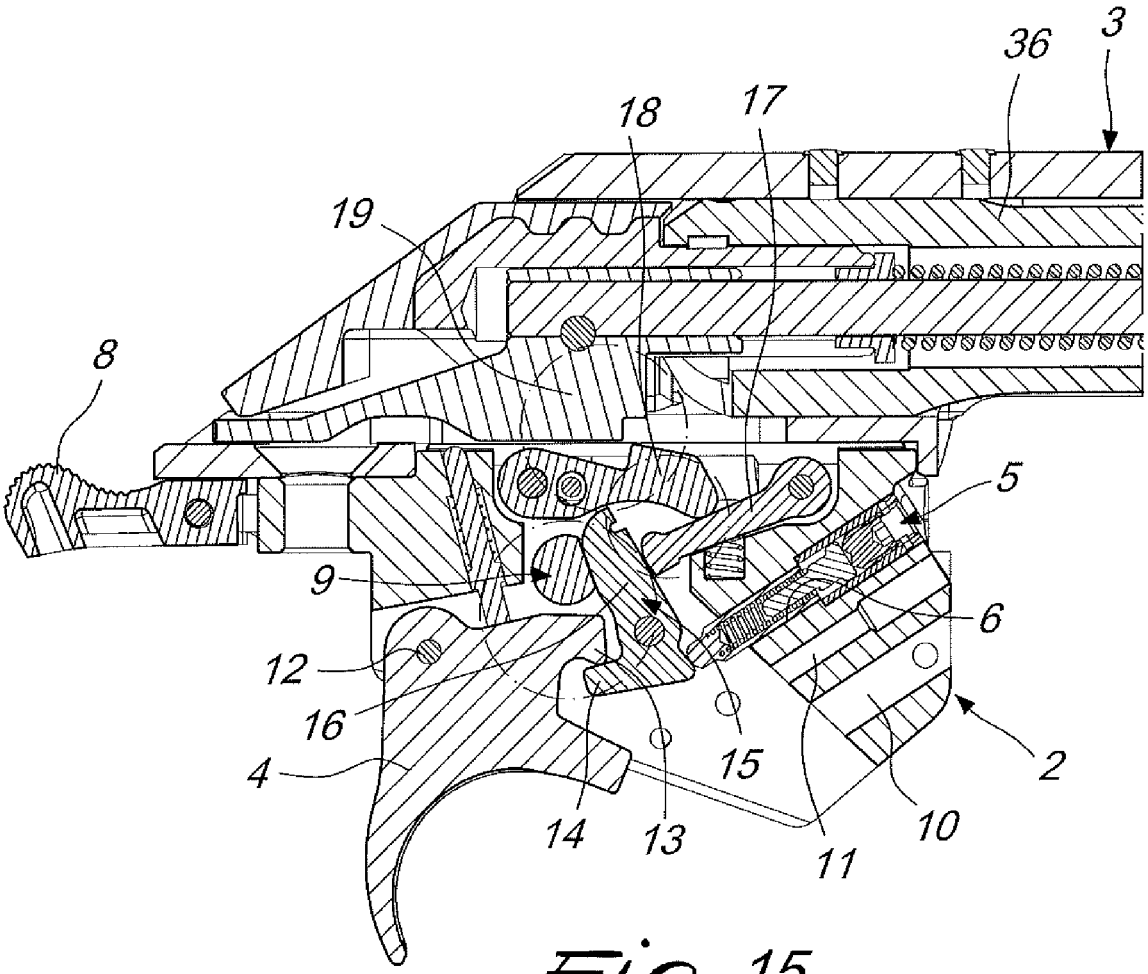
FIG. 15 is a section side view of the trigger unit and of part of the bolt and of the receiver of the firearm, shown in the firearm on fire and trigger pulled position.
Figure 16:
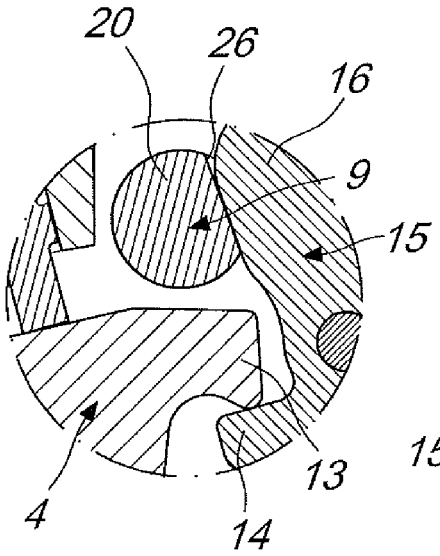
FIGS. 16-18 are enlarged views of details of FIG. 15.
Figure 17:
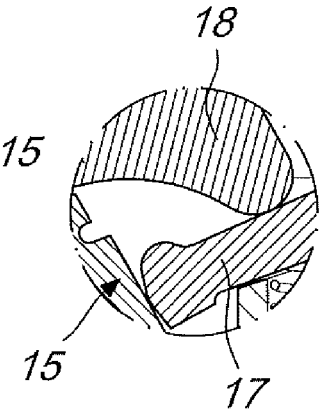
Figure 18:
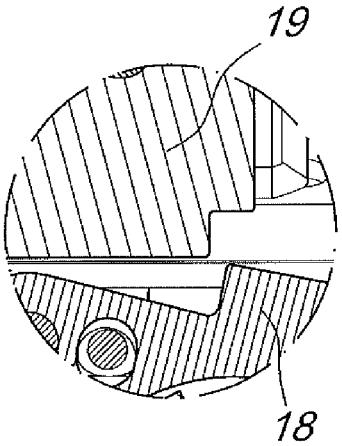

The safety tooth 15 interacts with the selector 9 both in the "on fire" position, shown more clearly in FIGS. 15-18, and in the "on safe" position, which is visible in FIGS. 9-10.

The safety tooth 15 interacts with the trigger 4 without relative sliding and always ensures the return of the reducer 17 and therefore of the hook tooth 18.

The safety tooth 15 also interacts with the trigger pull weight adjustment system and acts as a stroke limiter for the trigger, in the version with set trigger device, as will be described hereinafter.

The selector 9 is constituted by a cylindrical body 20 which has an end that is integral with a drum 21 and a free end.

The cylindrical body 20 is inserted in the support 2 and has a free end provided with an annular recess 22 which ensures the retention of a retaining snap ring 23.

The drum 21 has a V-shaped configuration, in the vertex 24 of which the end of a safety selection lever 25 is hinged, and which ensures a sharp selection of the safety from the on safe position to the on fire position and vice versa, as will be described hereinafter.

The cylindrical body 20 allows to set the firearm on safe, which is visible in FIGS. 9 and 10, by preventing the rotary movement of the safety tooth 15, avoiding the selection of the trigger teeth and their movement to the firearm on fire position.

The cylindrical body 20 has a flattened region 26 which, in the firearm on fire position, when the safety is disengaged, allows the rotation of the safety tooth 15 when the trigger is operated. The firearm on fire position, with the safety disengaged, is visible in FIGS. 11-14.

A recessed portion 27 of the cylindrical body 20, at the drum 21, allows to retain an O-ring 29 that has the function of reducing the selection noise of the safety.

A notch 28, formed at the vertex 24 of the V-shaped part of the drum 21, allows the movement of the safety section lever 25.

The safety of the trigger assembly according to the present invention has the button 8 connected to the plate 7, which acts on the selector 9 by means of a pivot 30 that is hinged in the drum 21 of the selector 9 and is engaged by a cam 31 of the plate 7.

The rotation of the drum 21 causes the movement of the safety selection lever 25, which is hinged, by means of a pivot 52, to the drum 21 and the free end of which acts on the firing pin engagement system.

Figure 23:
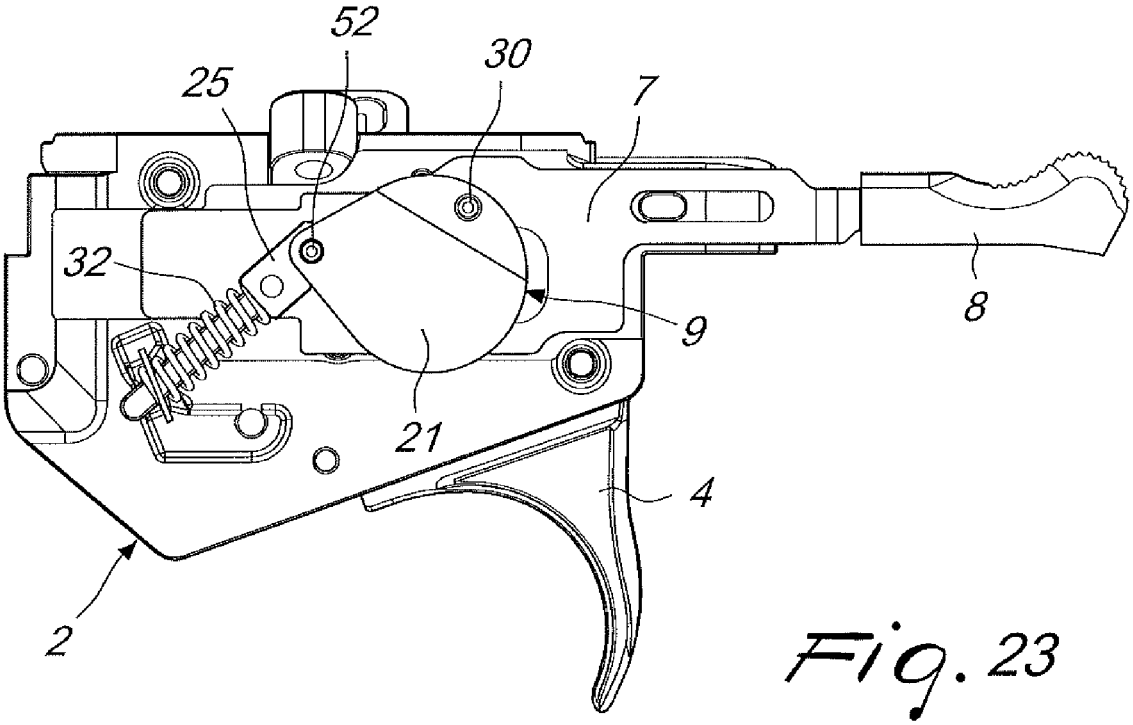
FIG. 23 is a side view of the trigger unit, shown in the firearm on safe position.
Figure 24:
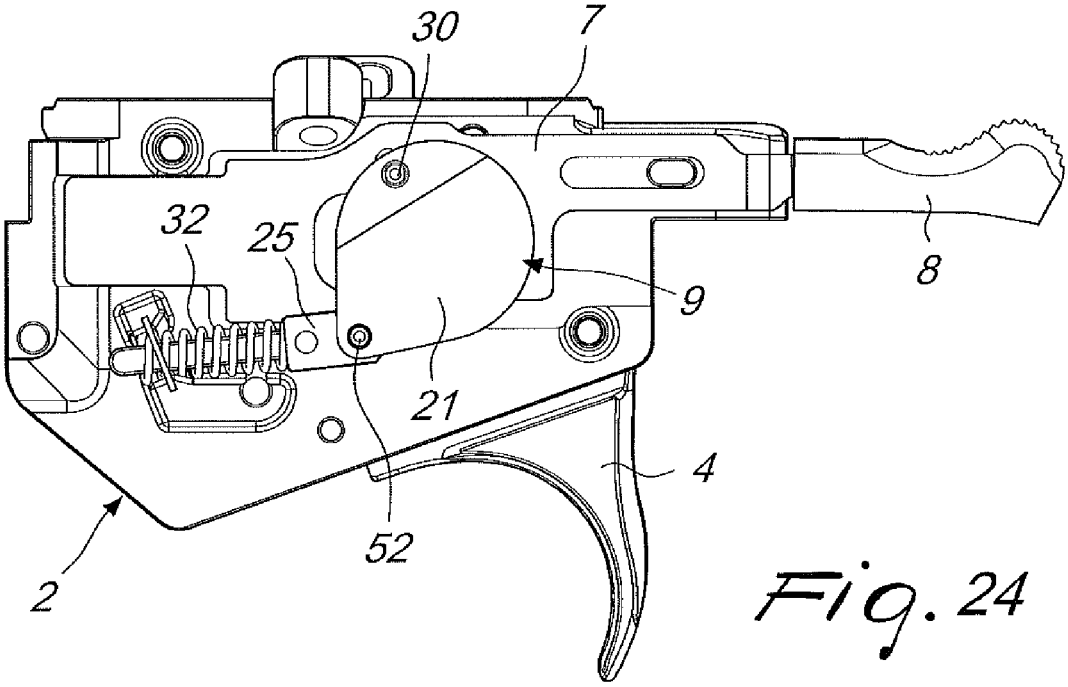
FIG. 24 is a side view, opposite with respect to the preceding one, of the trigger unit shown in the firearm on fire position.
Figure 25:
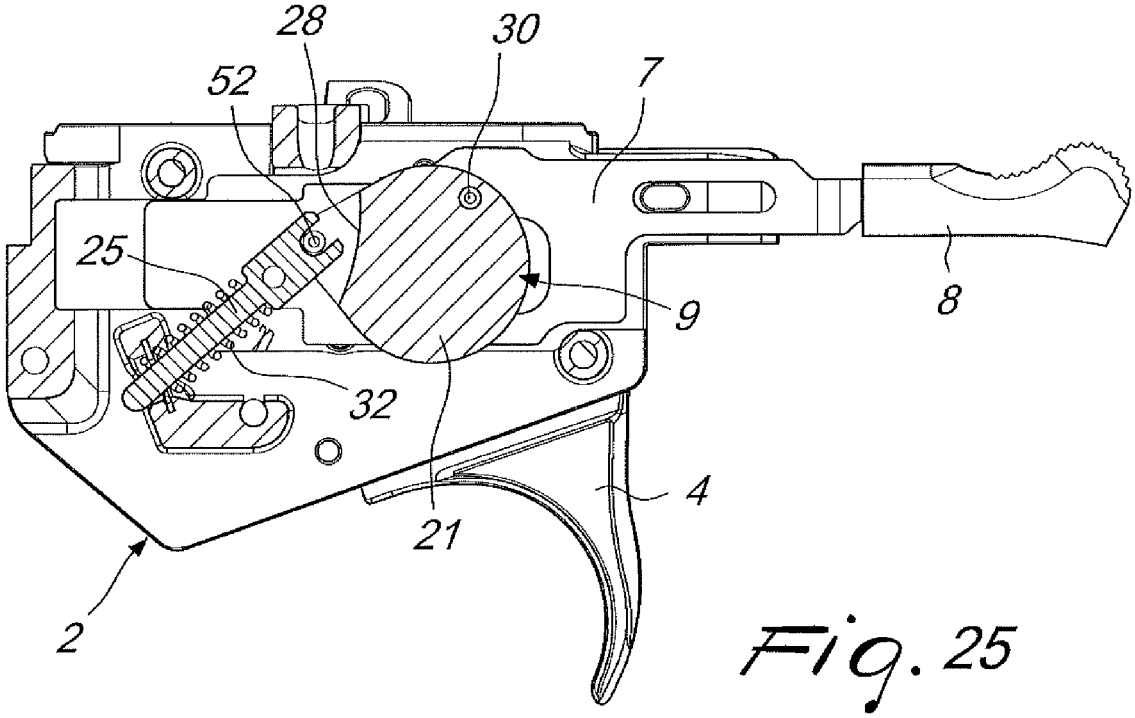
FIG. 25 is a section side view of the trigger unit, shown in the firearm on fire position.
Figure 26:
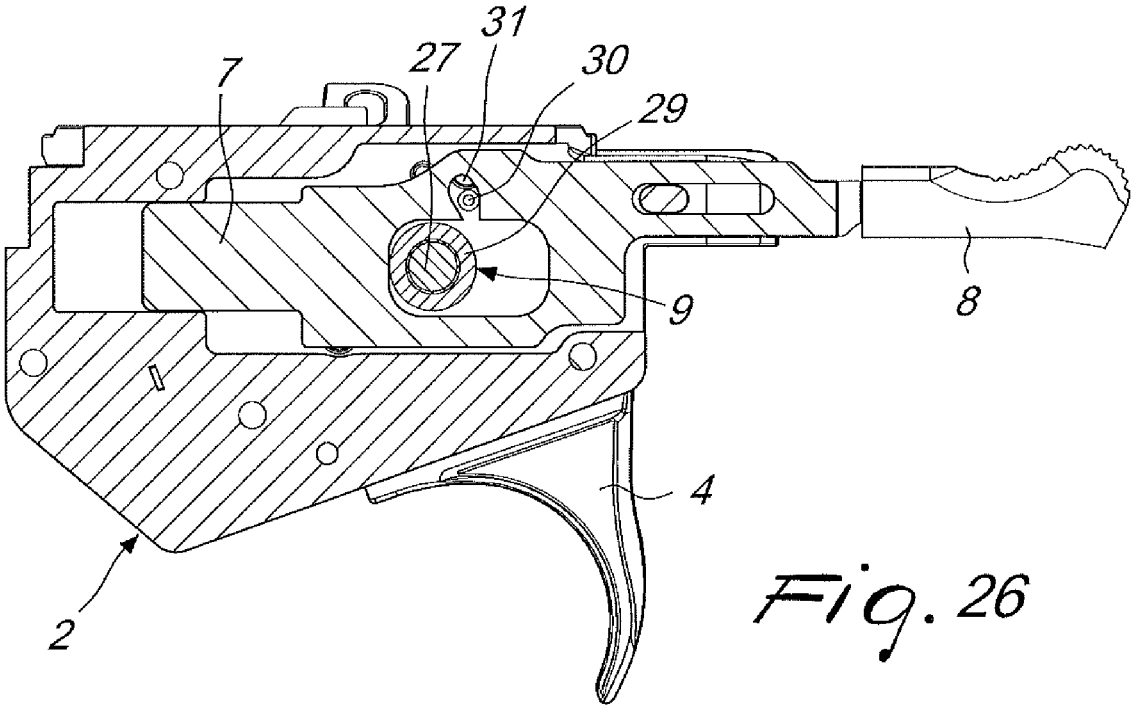
FIG. 26 is a section side view, taken along another section plane with respect to the preceding view, of the trigger unit shown in the firearm on safe position.
Figure 27:
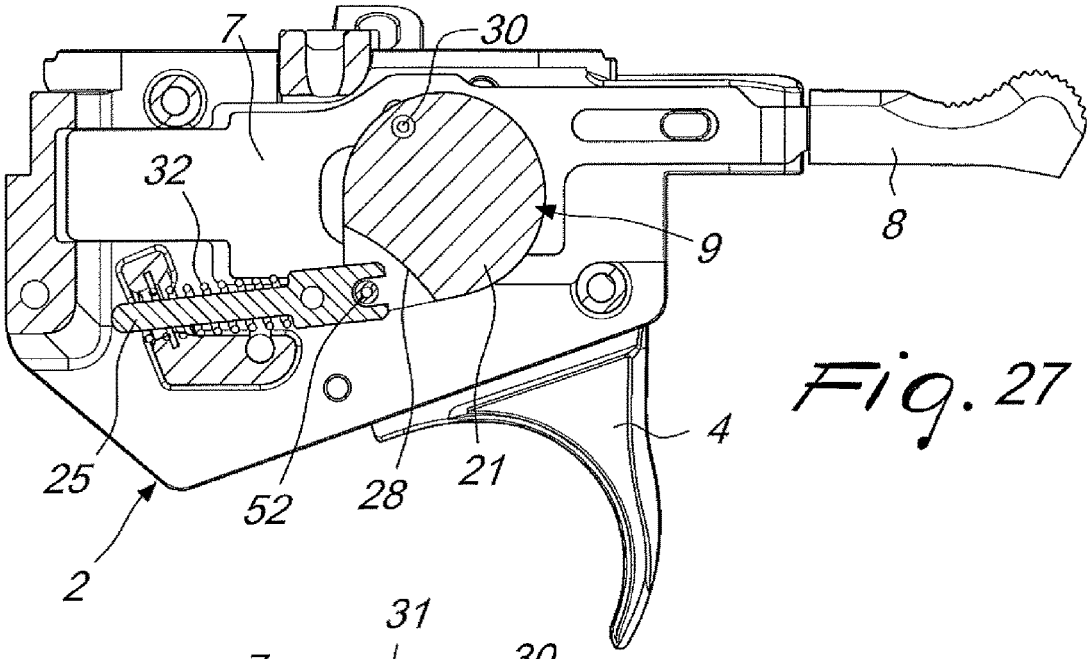
FIG. 27 is a section side view of the trigger unit, shown in the firearm on fire position.
Figure 28:
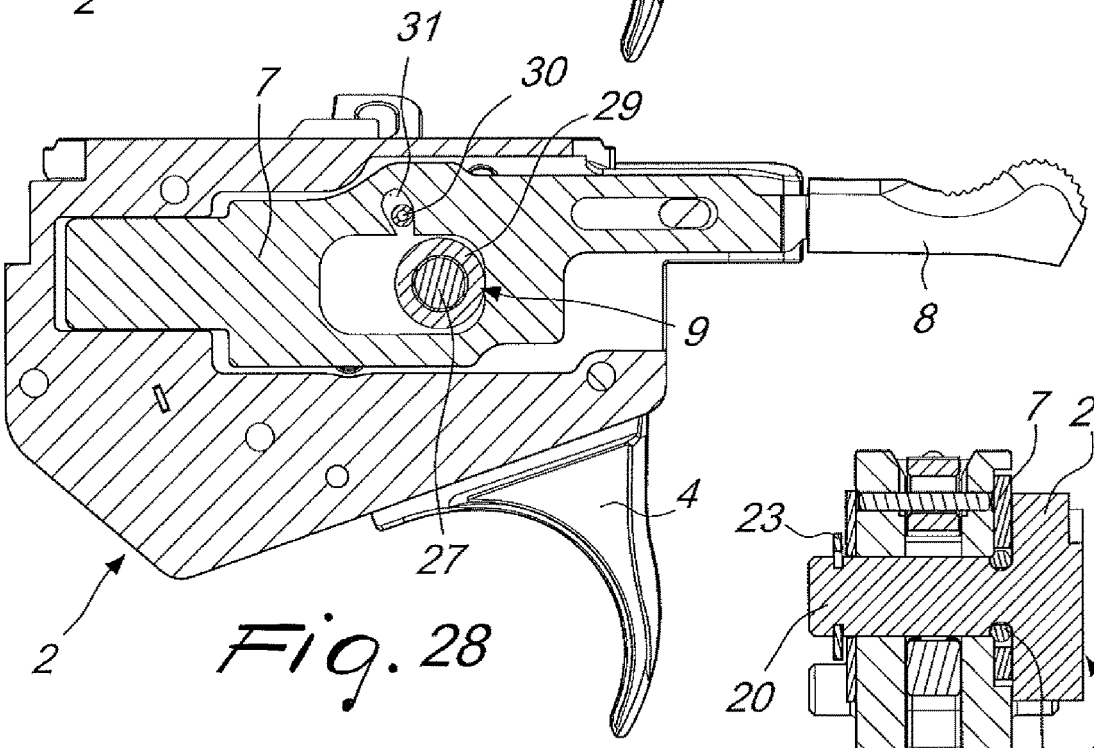
FIG. 28 is a section side view, opposite with respect to the preceding one, of the trigger assembly shown in the firearm on fire position.
Figure 29:
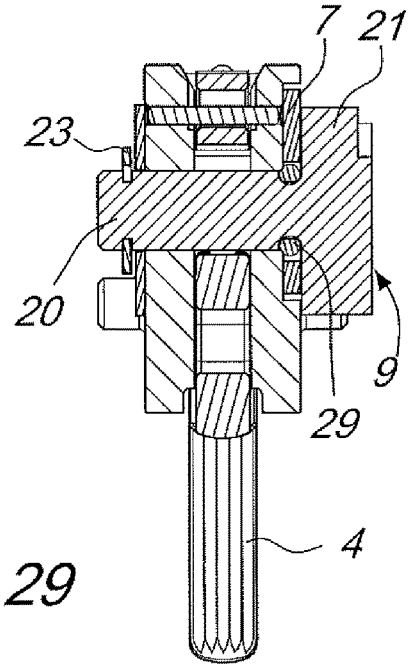
FIG. 29 is section front view of the trigger assembly.
Figure 30:
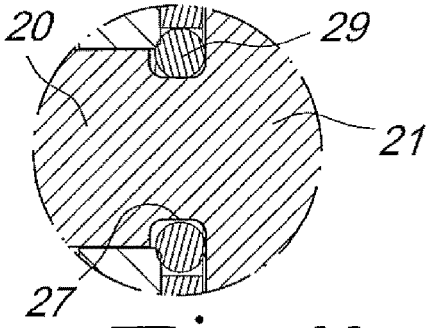
FIG. 30 is an enlarged view of a detail of FIG. 29.
Figure 31:
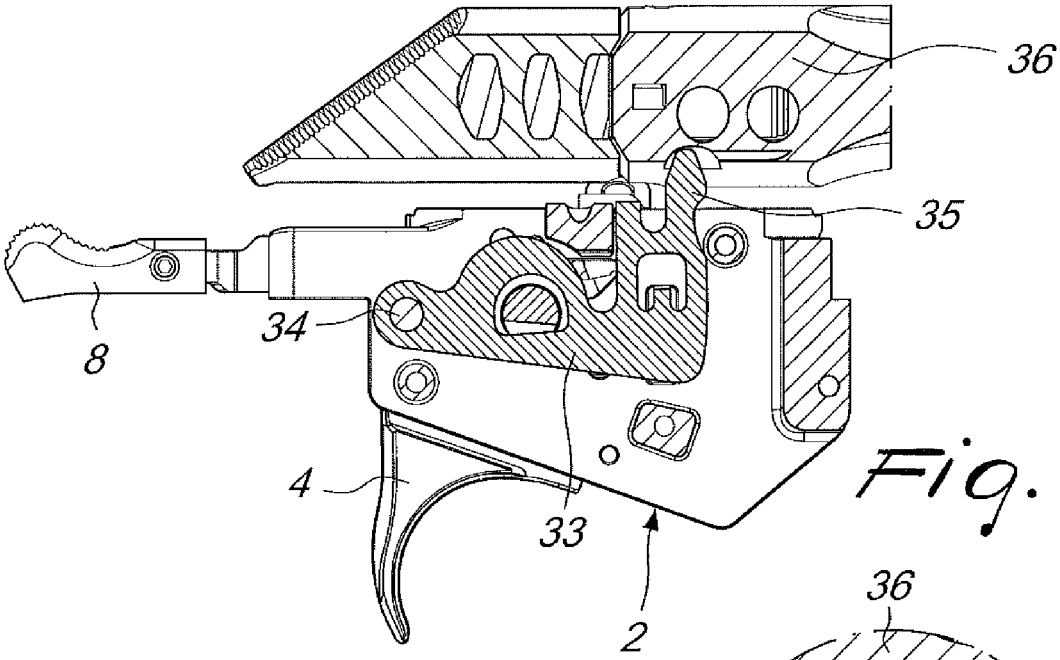
FIG. 31 is a partial section side view of the trigger unit and of the bolt, showing the trigger unit in the configuration with safety provided with bolt lock, in the bolt lock position.
Figure 32:
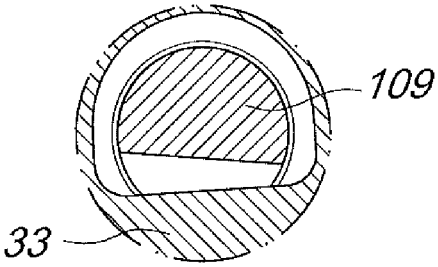
FIGS. 32-33 are enlarged views of details of FIG. 31.
Figure 33:
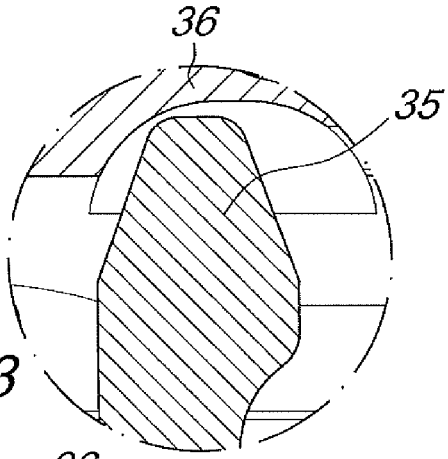
Figure 34:
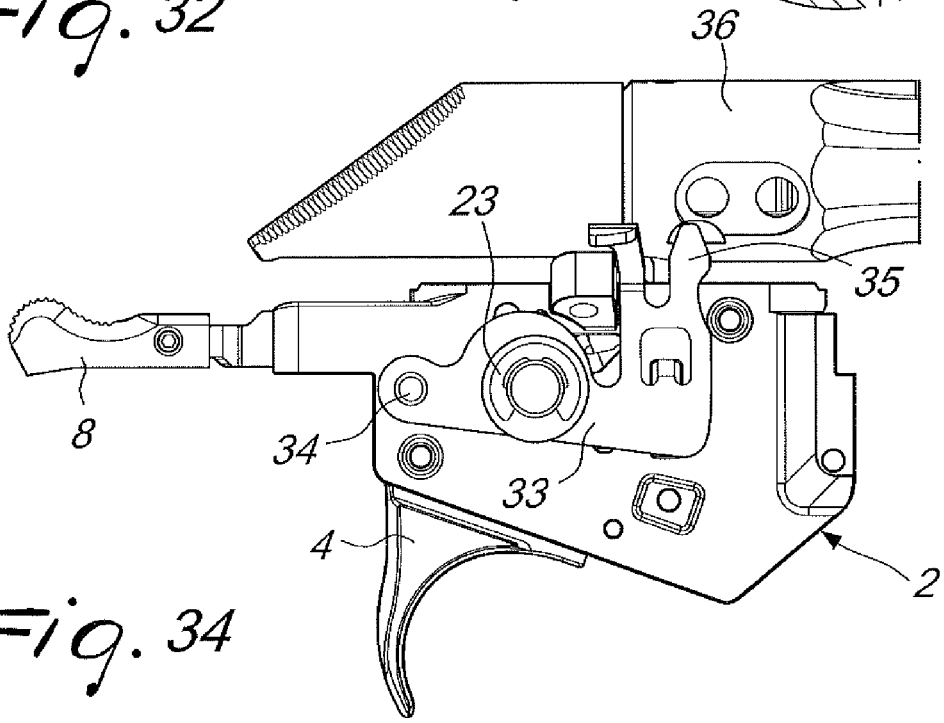
FIG. 34 is a side view of the trigger unit and of the bolt, showing the trigger unit in the configuration with safety provided with bolt lock, in the bolt lock position.
Figure 35:
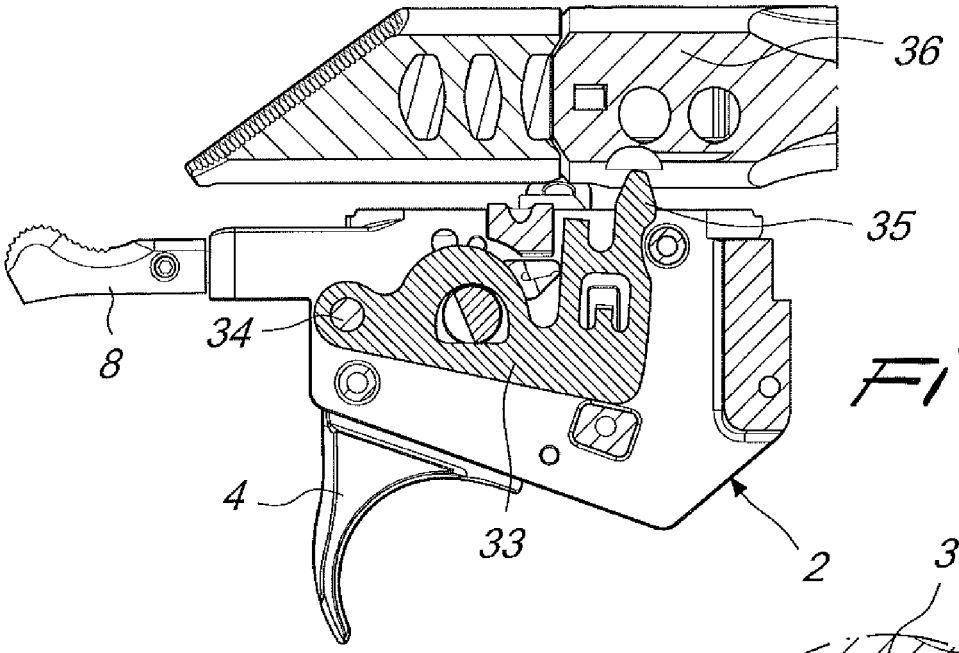
FIG. 35 is a partial section side view of the trigger unit and of the bolt, showing the trigger unit in the configuration with the safety provided with bolt lock, in the firearm on fire and bolt free position.
Figure 36:
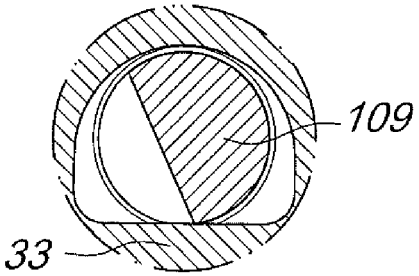
FIGS. 36-37 are enlarged views of details of FIG. 35.
Figure 37:
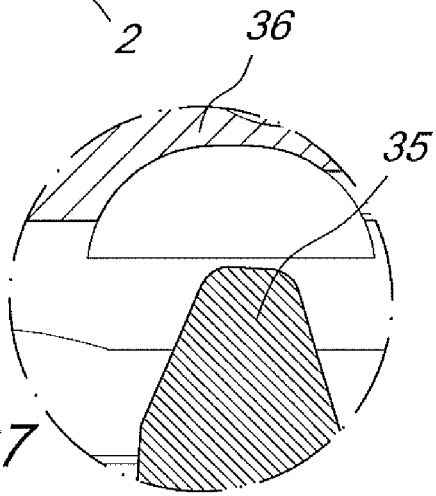
Figure 38:
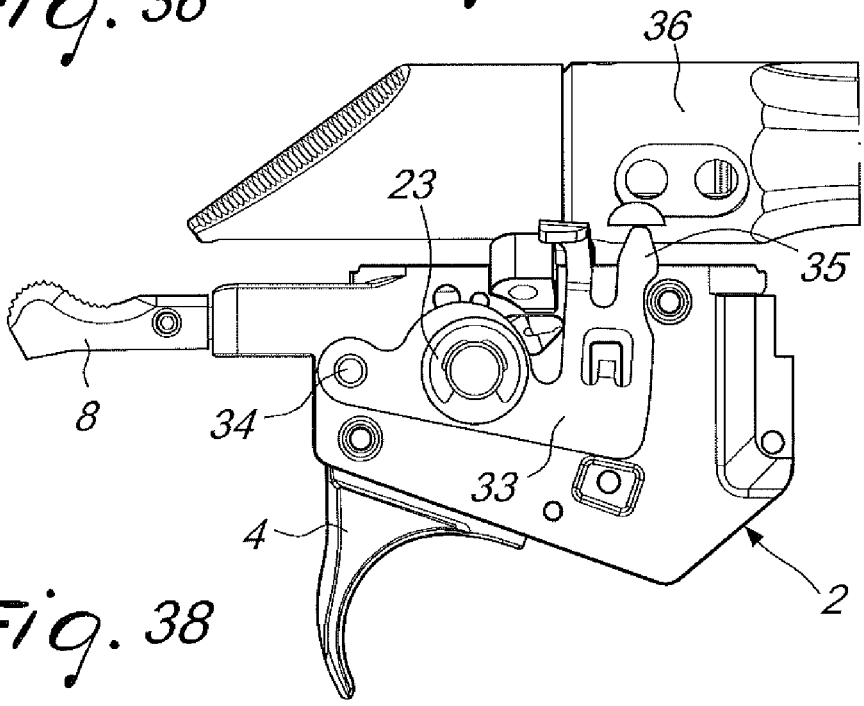
FIG. 38 is a side view of the trigger unit and of the bolt, showing the trigger unit in the configuration with safety provided with bolt lock, in the firearm on fire and bolt free position.

The sharp selection of the safety from the on safe position visible in FIGS. 23, 25 and 26 to the on fire position, visible in FIGS. 24, 27 and 28, and vice versa is ensured by the V-shaped configuration of the drum 21 of the selector 9 and by a spring 32 of the safety selection lever 25.

The safety selection lever 25 has a fork-shaped end which facilitates its assembly and disassembly without dedicated tools.

The safety of the new trigger unit is a translating, central and ambidextrous safety, and therefore can be easily operated by all users.

In order to ensure silent operation of the safety, the O-ring 29 is arranged in the recessed portion 27 of the cylindrical body 20 and is therefore interposed between the drum 21 of the selector 9 and the plate 7.

FIGS. 9-10 are views of the trigger unit with the configuration described above, in the firearm on safe position.

FIGS. 11-14 are views of the trigger unit in the firearm on fire position.

FIGS. 15-18 are views of the trigger unit in the firearm on fire position, with the trigger pulled.

Figure 19:
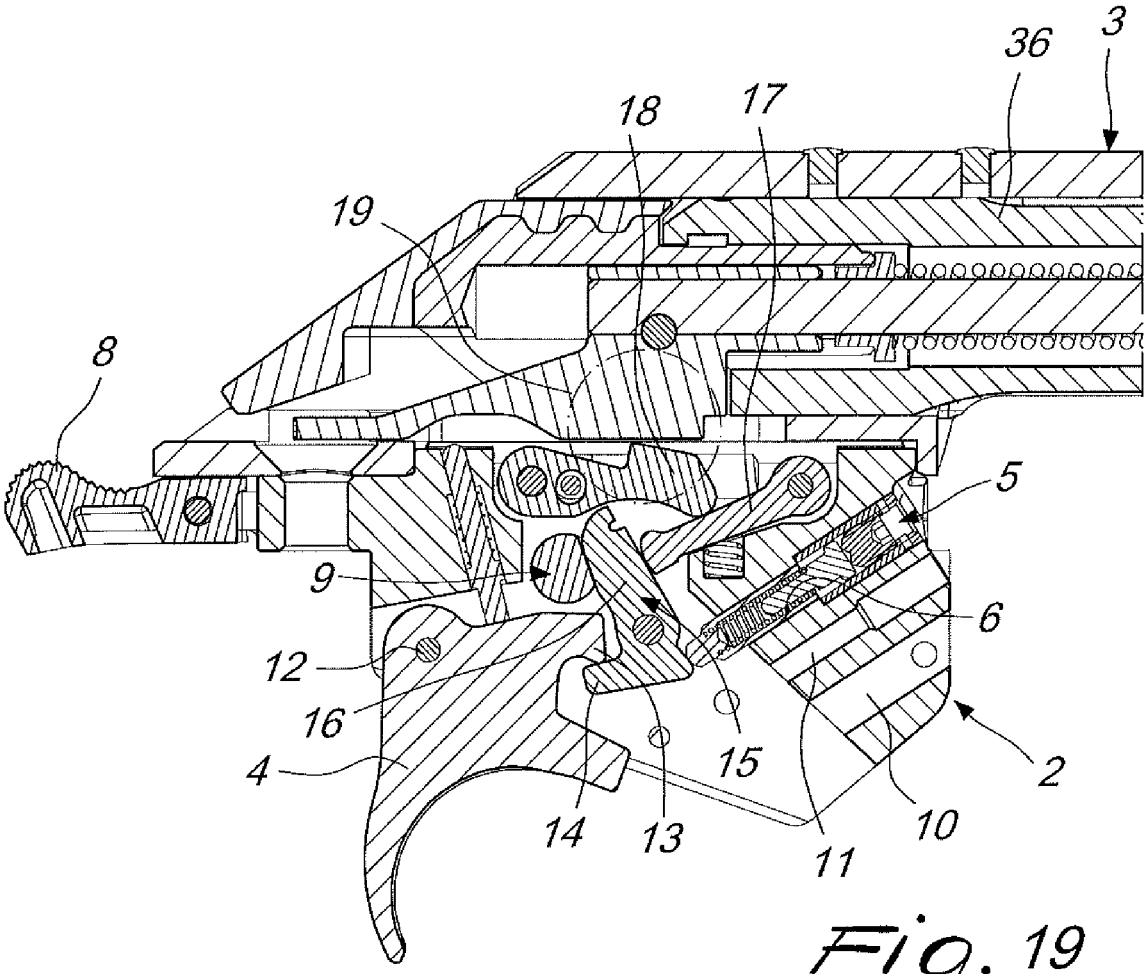
FIG. 19 is a section side view of the trigger unit and of part of the bolt and of the receiver of the firearm, shown in the firearm on fire position, with the trigger pulled and floating firing pin.
Figure 20:
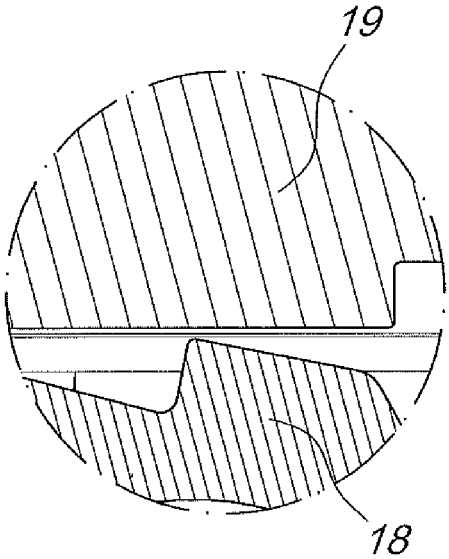
FIG. 20 is an enlarged view of a detail of FIG. 19.
Figure 21:
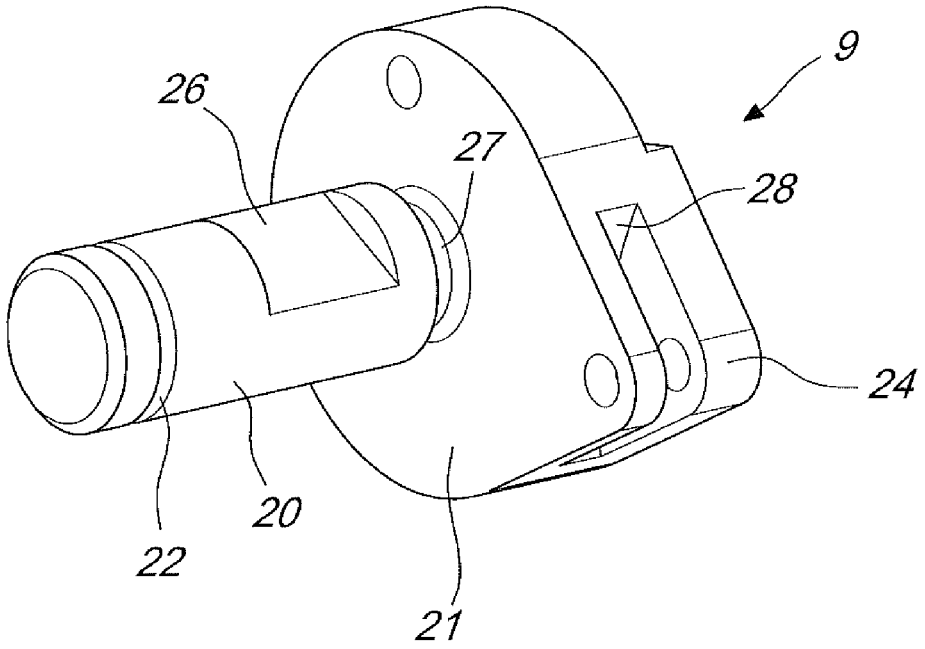
FIGS. 21 and 22 are perspective views of the selector for configuring the trigger unit with simple safety, without bolt locking, and without set trigger device.
Figure 22:
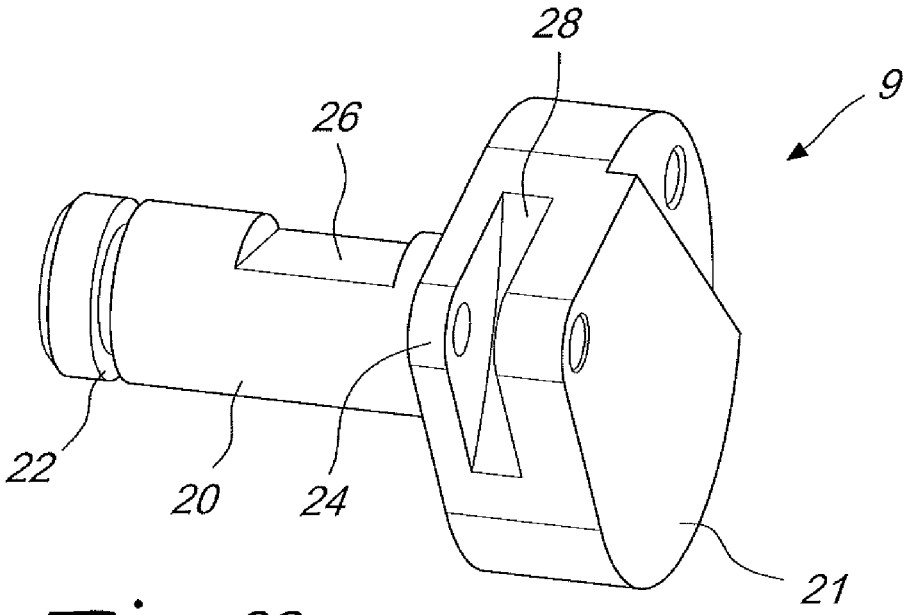

FIGS. 19-20 are views of the trigger unit in the firearm on fire position, with the trigger pulled and a floating firing pin.

FIGS. 31-40 are views of a constructive example of the trigger unit provided with a system for locking the bolt when the safety is activated.

The bolt locking system has a bolt locking plate 33 which is hinged to the support 2 in a pivot 34 and has a tab 35 which interferes with the movement of the bolt 36, preventing its rotation, when the firearm is on safe; this position is shown in FIGS. 7, 31-34.

In this configuration, the trigger unit is fitted with a selector 109 which is modified with respect to the selector described above by the presence of a notch 133 formed in the cylindrical body 20, in a position close to the annular recess 22 of the free end of the cylindrical body 20.

Figure 39:
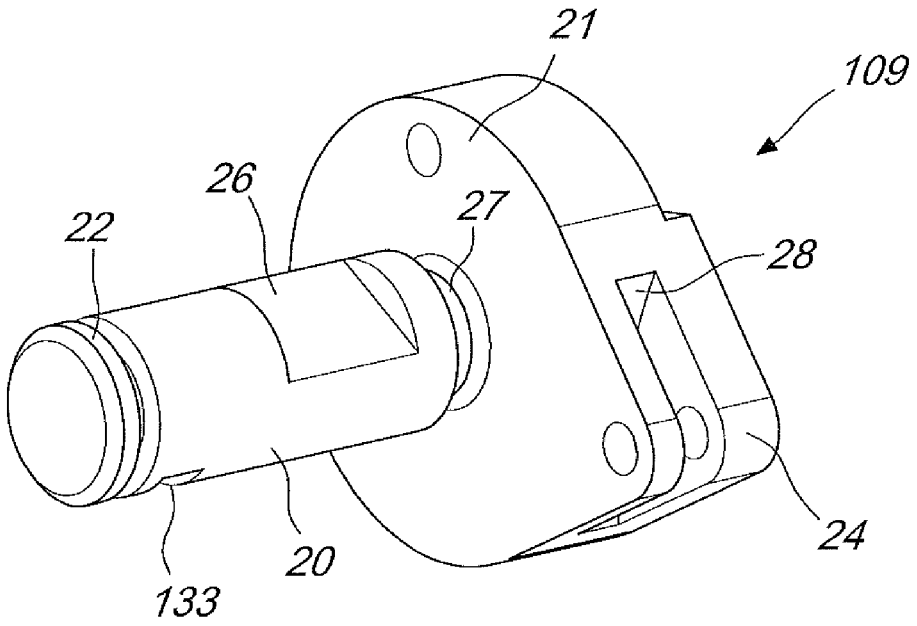
FIGS. 39 and 40 are perspective views of the selector for configuring the trigger unit with safety with bolt lock and without set trigger device.
Figure 40:
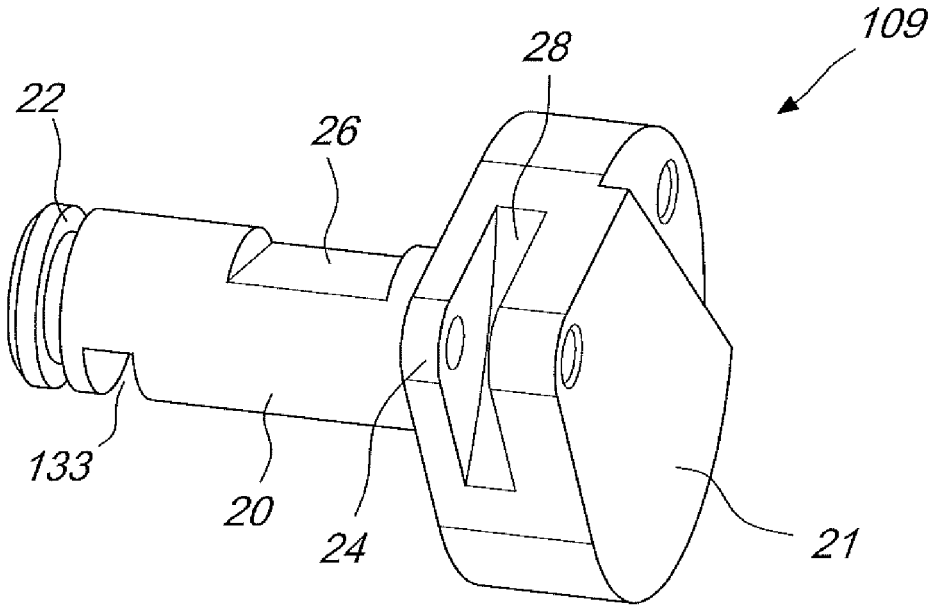

The bolt 109 is shown in FIGS. 39 and 40.

The notch 133 allows an upward rotation of the bolt locking plate 33 when, by means of the button 8 and the plate 7, the selector 109 is turned in order to set the firearm on safe.

In the firearm on fire position, i.e., when the safety is not activated, the bolt locking plate 33 is lowered and its tab 35 does not interfere with the bolt 36, allowing its rotation, as shown in FIGS. 35-38.

The trigger unit according to the present invention has a trigger pull weight adjustment system.

The trigger pull weight adjustment system, which is visible in detail in FIGS. 41-44, has a trigger pull weight adjustment device 5 inserted in a seat 6 provided in the support 2.

The trigger pull weight adjustment device 5 has a piston 37 that transfers the load to the safety tooth 15 of the trigger.

The pull weight is generated by a spring 38 that is mounted coaxially with respect to a spring guide pin 39 on which an adjustment grub screw 40 acts.

The adjustment grub screw 40 is surrounded by an unscrewing prevention insert 42 associated with a threaded sleeve 41.

The adjustment system allows to continuously adjust the trigger pull weight, from a minimum value (FIG. 41) to a maximum value (FIG. 43), by the movement of a single threaded body, i.e., of the adjustment grub screw 40 joined to the threaded sleeve 41.

This adjustment range is predefined: the dimensions of the threaded body 40, 41 and of the spring guide pin 39 prevent an excessively low pull weight adjustment, which would cause the failure of the safety tooth 15 of the trigger to return, or an excessively high one, which would cause the risk of improper locking of the trigger.

The trigger adjustment system, constituted by the single adjustment grub screw 40 inserted in the threaded sleeve 41, which is made of metallic material, and in the unscrewing prevention insert 42, which is made of polymer, constitutes an integrated unscrewing prevention system without a complementary grub screw; the polymer body ensures the constancy of the trigger pull weight.

Access to the adjustment grub screw 40 is facilitated by the fact that it is sufficient to disassemble the magazine, a basic operation for loading the firearm, and translate the bolt 36 to the open position; it is not necessary to disassemble the barrel and the sight, with the consequent needs to calibrate the aim again.

Pull weight adjustment can be performed by means of a commercial hex key.

The wear resistance of the trigger adjustment system does not depend on the material of the guard support 2 because the threaded sleeve 41 allows the accommodation of the adjustment system, even in guard supports made of polymer.

Figure 41:
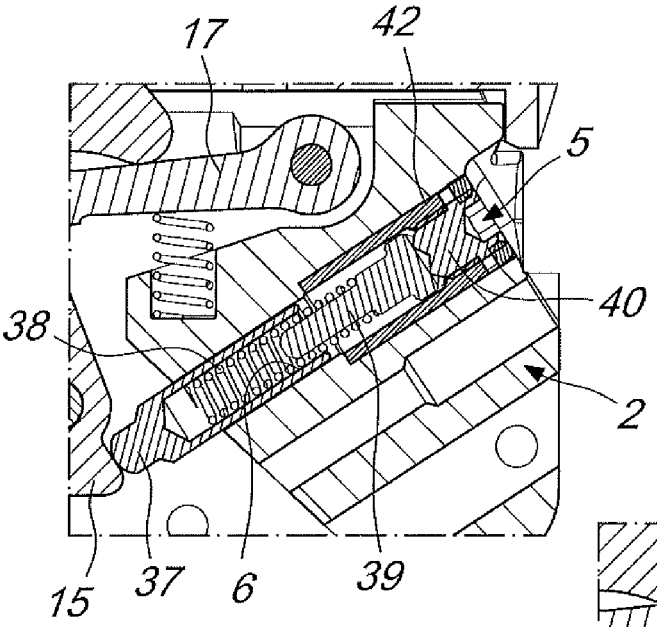
FIG. 41 is a section side view of the trigger pull weight adjustment system, shown in the minimum trigger pull weight position.
Figure 42:
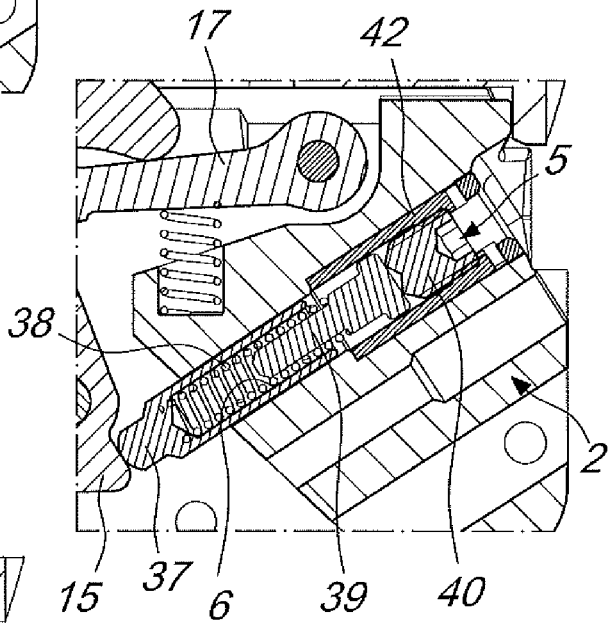
FIG. 42 is a section side view of the trigger pull weight adjustment system, shown in the medium trigger pull weight position.
Figure 43:
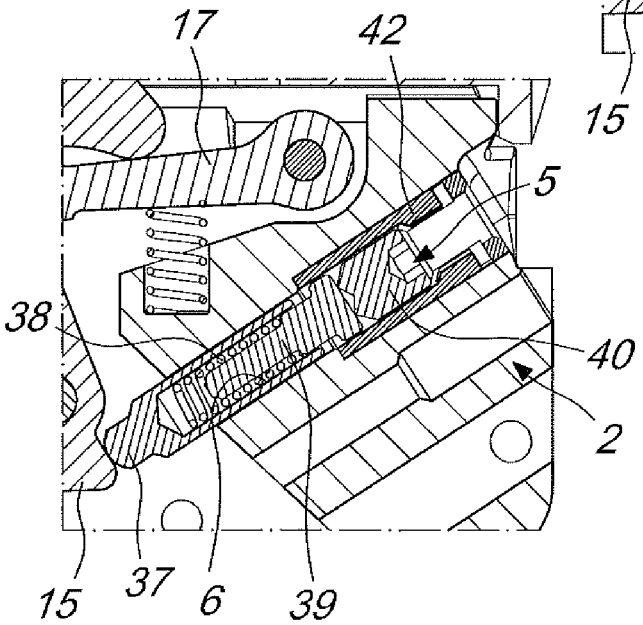
FIG. 43 is a section side view of the trigger pull weight adjustment system, shown in the maximum trigger pull weight position.
Figure 44:
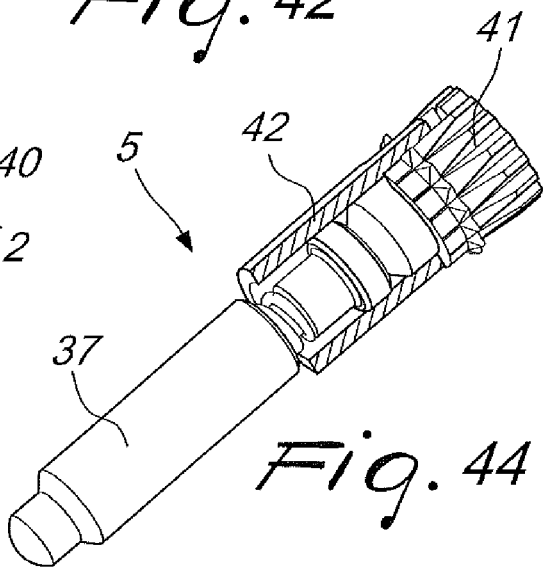
FIG. 44 is a perspective view of the trigger pull weight adjustment device.

FIGS. 41, 42 and 43 are views of the adjustment system respectively in the minimum pull weight (FIG. 41), medium pull weight (FIG. 42) and maximum pull weight (FIG. 43) positions.

According to a further configuration of the trigger unit, according to the present invention, a set trigger device is integrated in the support 2 and is generally designated by the reference numeral 43.

As is known, a set trigger device is a device that allows to minimize both the stroke of the trigger and the trigger pull weight and adds a minimum trigger pull weight level in addition to the one that is normally available with the adjustment system.

Figure 45:
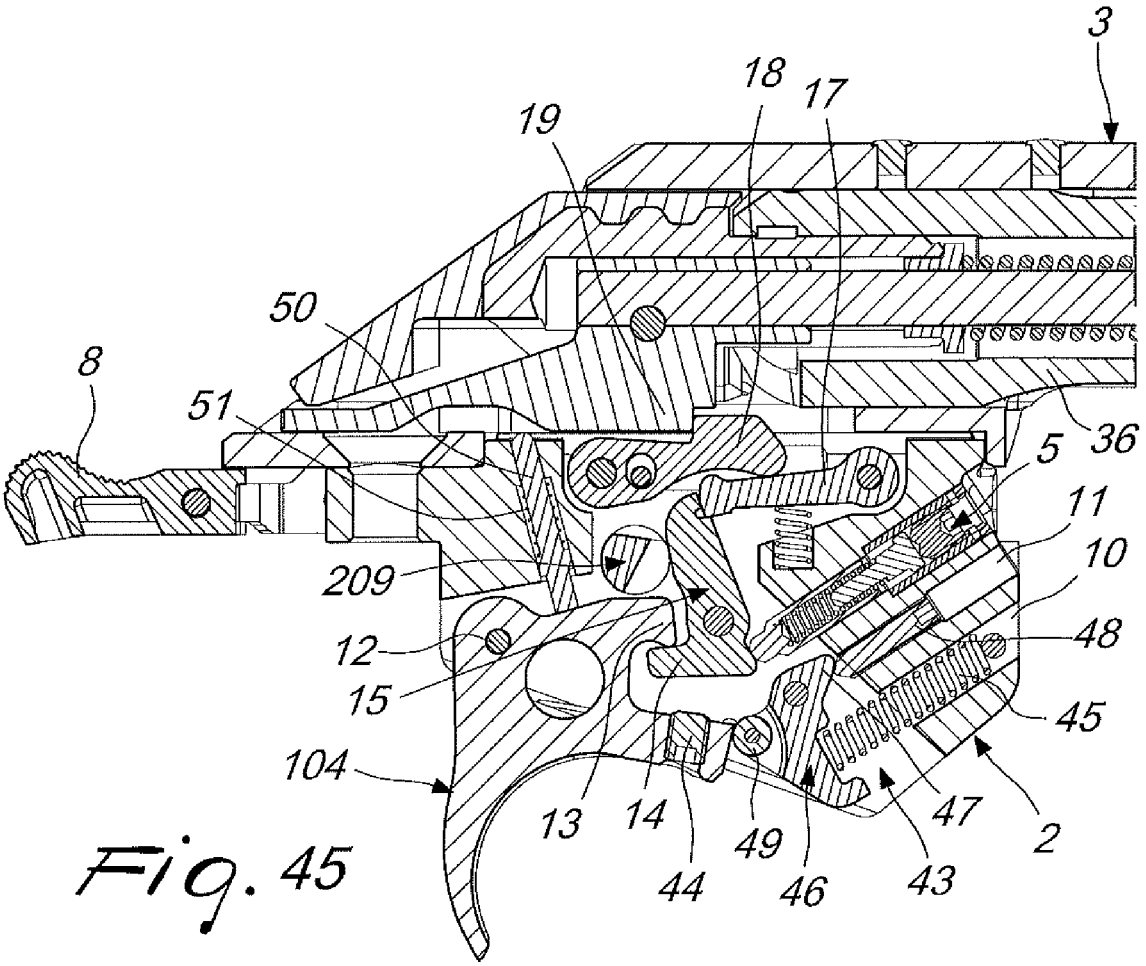
FIG. 45 is a section side view of the trigger unit and of part of the bolt and of the receiver of the firearm, in the configuration with set trigger device, shown in the firearm on safe position.

The configuration of the trigger unit with a set trigger device is shown in FIG. 45 onward.

In this configuration, the trigger unit has a trigger 104, which is pivoted to the support 2 by means of a pivot 12 and is provided with a protrusion 13 that is adapted to interact with the lower protrusion 14 of the safety tooth 15 pivoted to the support 2.

The components of the trigger 104 that are similar to the components of the trigger 4 described above are identified by identical reference numerals.

In general, all the similar components of the trigger unit in the various configurations are designated by the same reference numerals.

Figure 50:
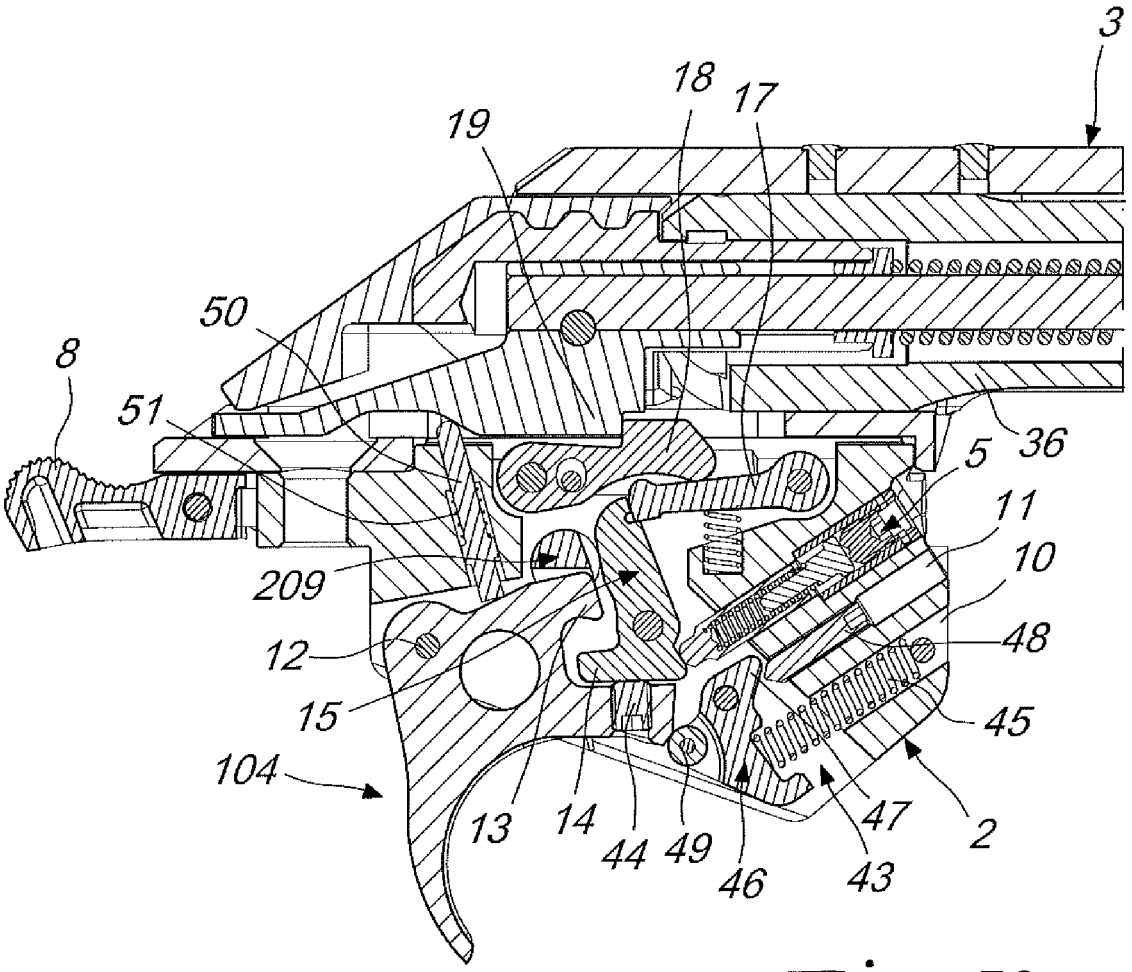
FIG. 50 is a section side view of the trigger unit and of part of the bolt and of the receiver of the firearm, in the configuration with set trigger device, shown in the firearm on fire, trigger engaged, and set trigger device engaged position.
Figure 51:
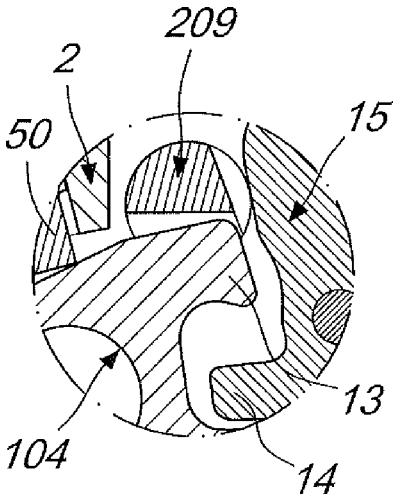
FIGS. 51-53 are enlarged views of details of FIG. 50.
Figure 52:
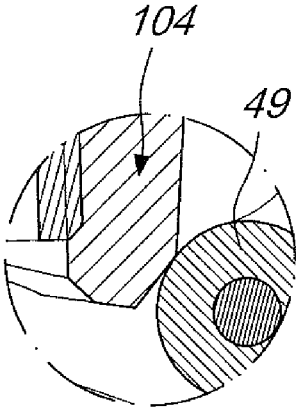
Figure 53:
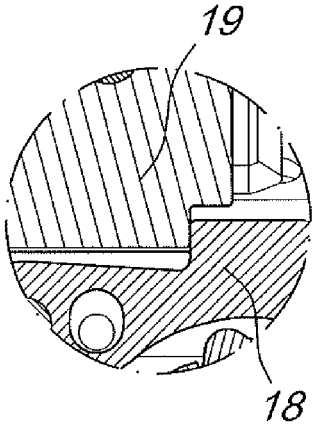
Figure 54:
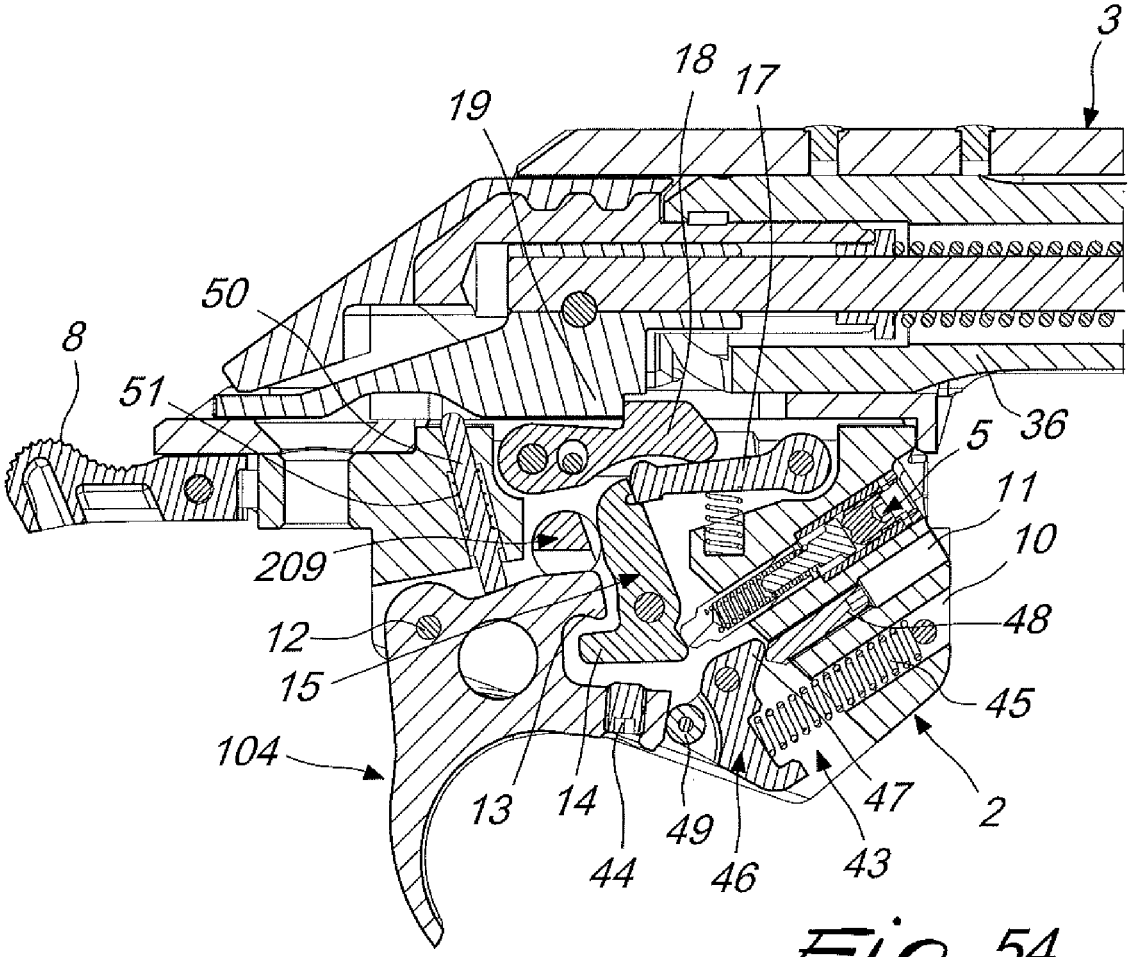
FIG. 54 is a section side view of the trigger unit and of part of the bolt and of the receiver of the firearm, in the configuration with set trigger device, shown in the firearm on fire, floating trigger and set trigger device engaged position.
Figure 55:
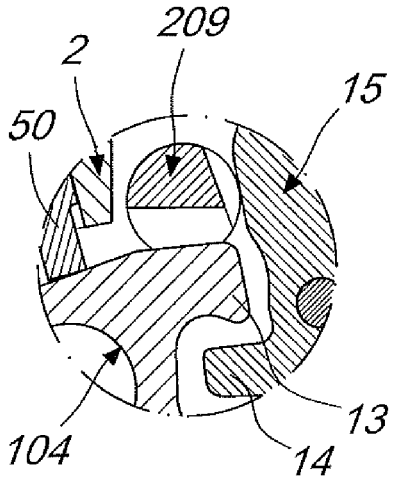
FIGS. 55-57 are enlarged views of details of FIG. 54.
Figure 56:
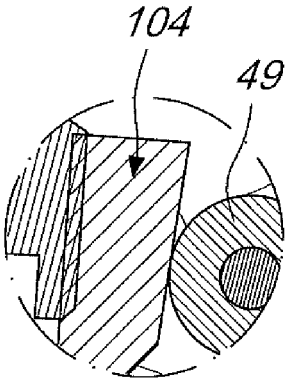
Figure 57:
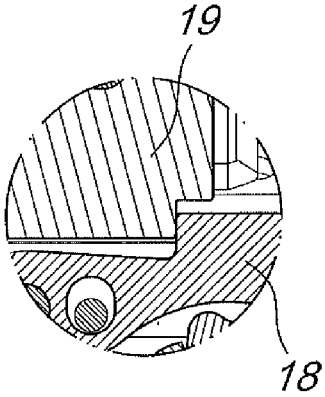
Figure 58:
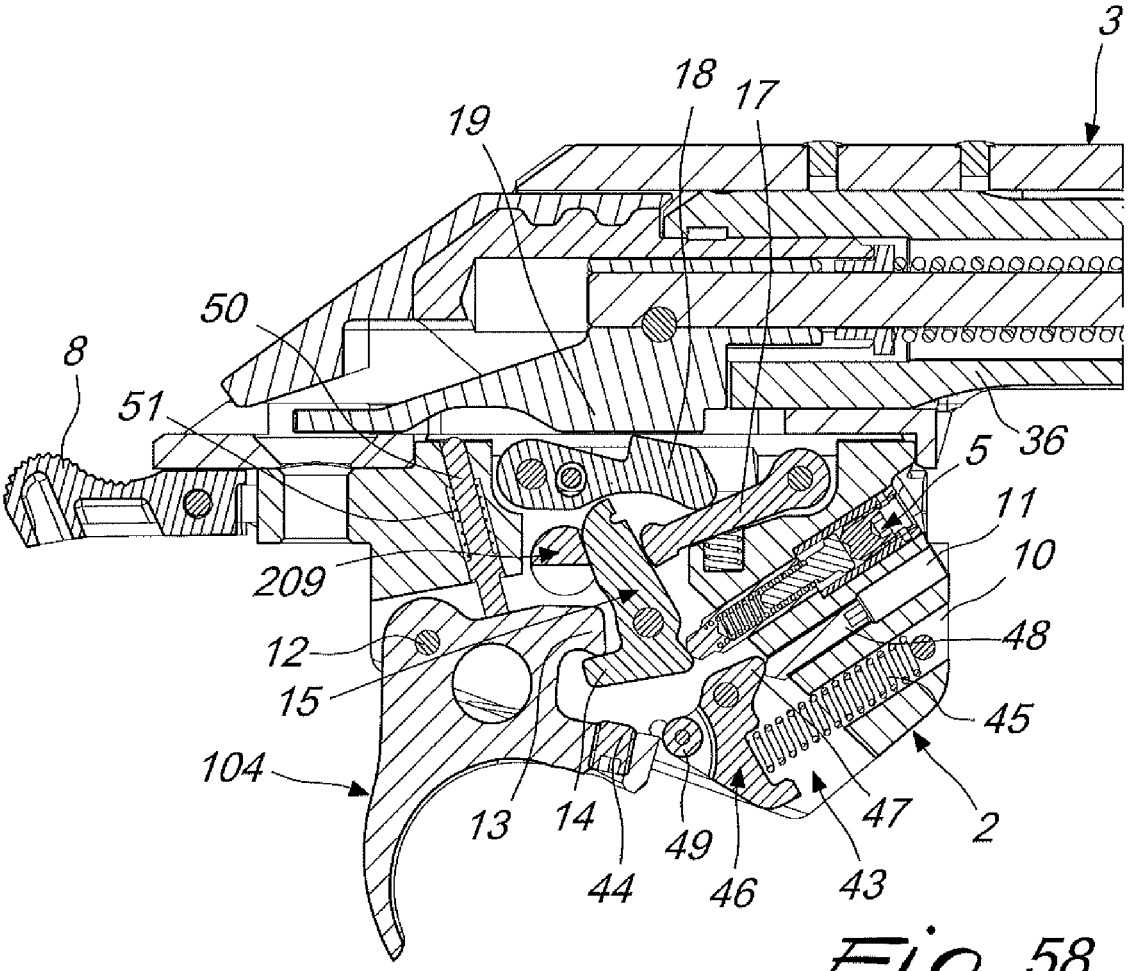
FIG. 58 is a section side view of the trigger unit and of part of the bolt and of the receiver of the firearm, in the configuration with set trigger device, shown in the firearm on fire, floating bolt and set trigger device at the end of action position.
Figure 59:
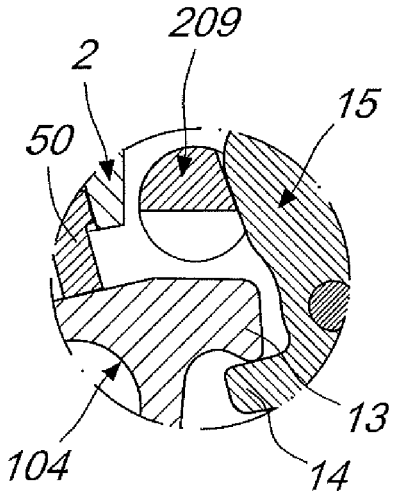
FIGS. 59-61 are enlarged views of details of FIG. 58.
Figure 60:
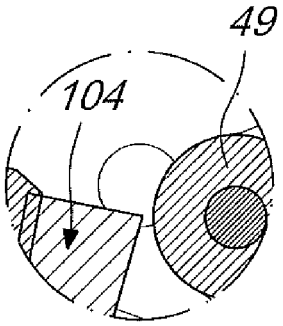
Figure 61:
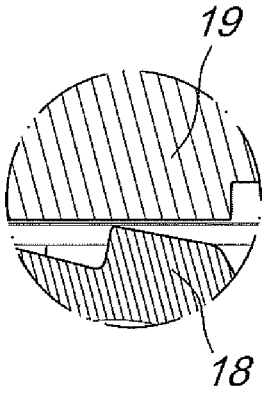

The trigger 104 includes an adjustment grub screw 44 which allows to adjust the position of the trigger rotated forward with respect to the lower protrusion 14 of the safety tooth 15, in the position in which the firearm is on fire, the trigger is engaged and the set trigger device is engaged (FIG. 50).

The set trigger device has a set trigger device spring 45, which is inserted in the seat 10 of the support 2 and acts on an anchor 46 that is pivoted to the support 2.

The anchor 46 is provided with a first end 47, which remains in abutment with the end of an adjustment screw 48, inserted in the threaded seat 11 of the support 2, and a second end provided with a roller 49 that is adapted to interact with the lower part of the trigger 104.

A pusher pin 50 provided with a coil spring 51 and inserted in a seat of the support 2 keeps the trigger 104 in contact with the safety tooth 15.

Figure 62:
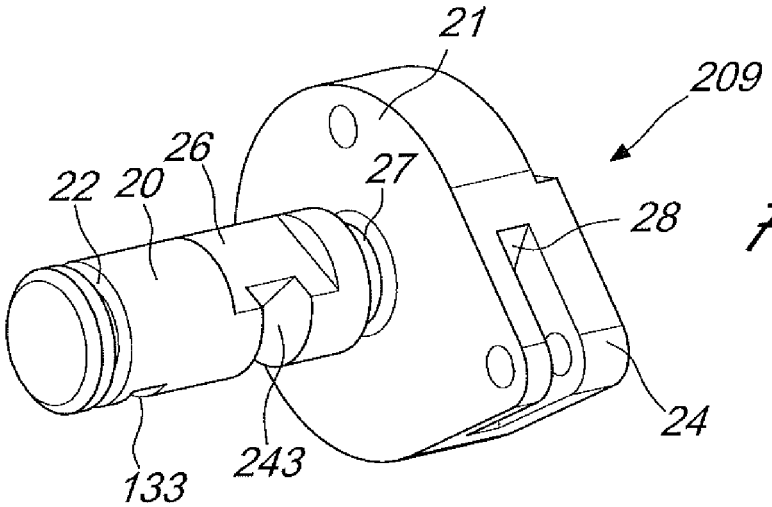
FIGS. 62 and 63 are perspective views of the selector for configuring the trigger unit with safety with bolt lock, and with set trigger device.
Figure 63:
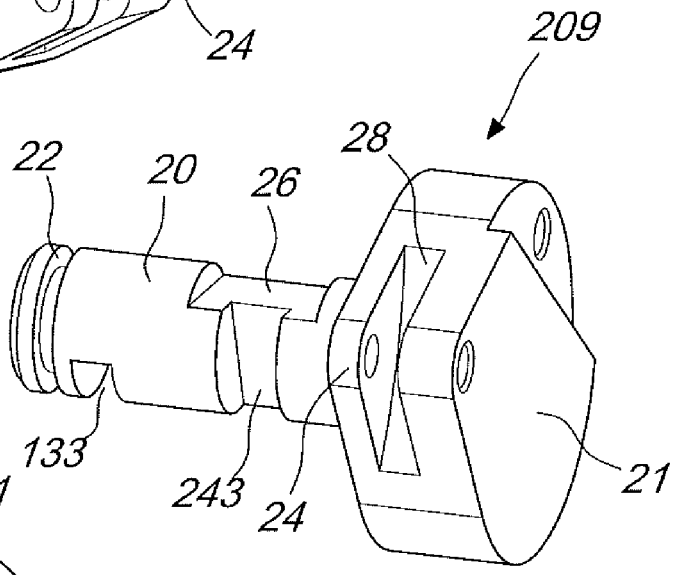

In the configuration with set trigger, the trigger unit 1 has a selector 209, shown in FIGS. 62 and 63, which has a set trigger device notch 243 which is formed at the flattened region 26 of the cylindrical body 20 and allows the selection of the trigger in order to activate the set trigger device.

The selector 209 also has the notch 133, formed in the cylindrical body 20, for the configuration of the trigger unit with the bolt locking plate 33.

Figure 64:
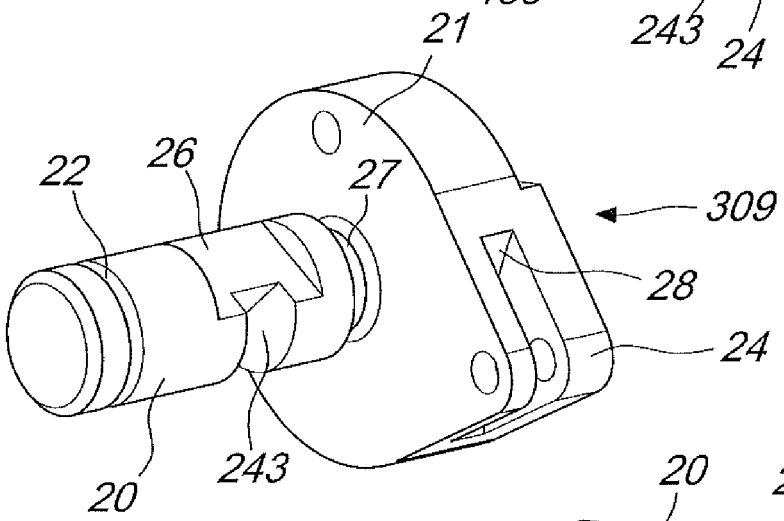
FIGS. 64 and 65 are perspective views of the selector for configuring the trigger unit with simple safety, without bolt lock, and with set trigger device.
Figure 65:
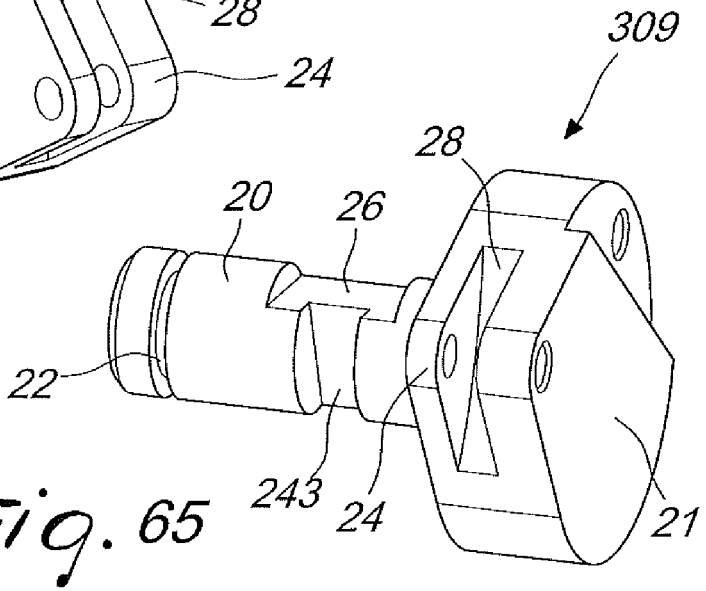

FIGS. 64 and 65 are views of a selector 309 adapted for a configuration of the trigger unit with set trigger but without bolt locking plate. The selector 309 is provided with the set trigger device notch 243, which is formed at the flattened region 26 of the cylindrical body 20, but is not provided with the notch 133 for the bolt locking plate 33.

Figure 46:
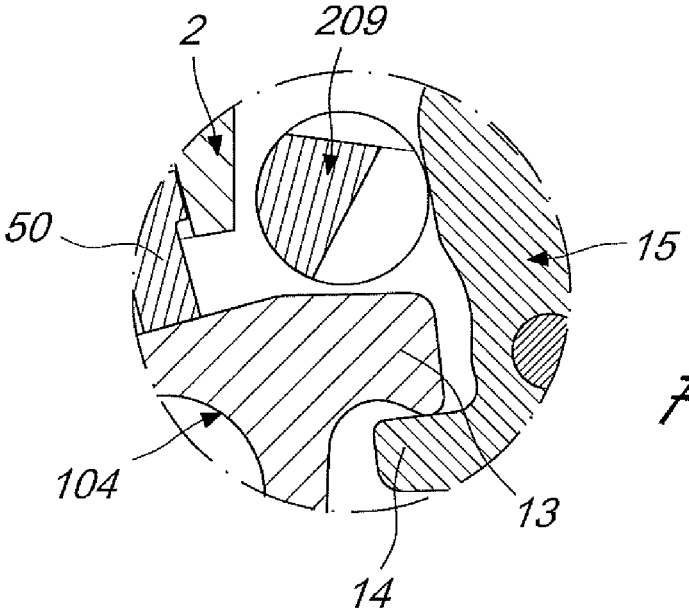
FIG. 46 is an enlarged view of a detail of FIG. 45.

FIGS. 45-46 are views of the trigger unit in the firearm on safe position in which the set trigger device cannot be engaged.

Figure 47:
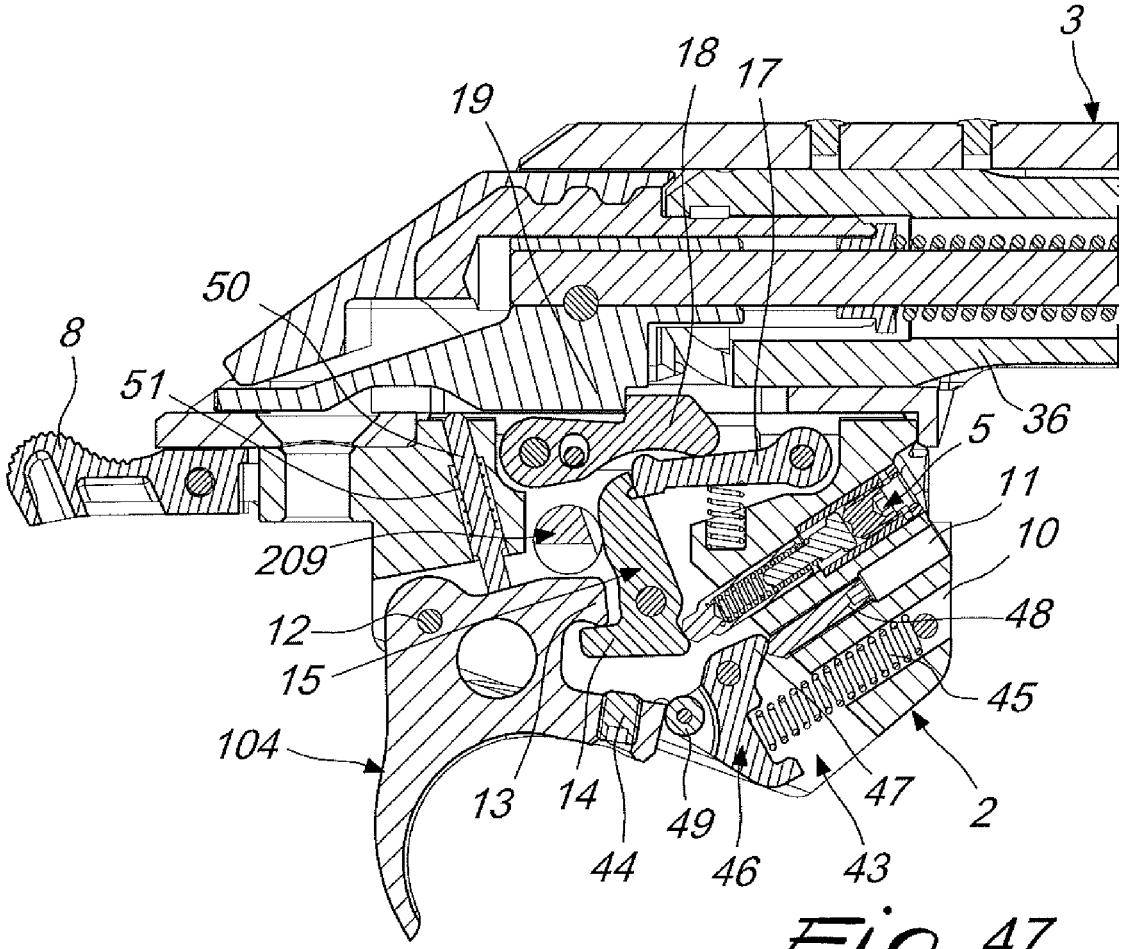
FIG. 47 is a section side view of the trigger unit and of part of the bolt and of the receiver of the firearm, in the configuration with set trigger device, shown in the firearm on fire, trigger at rest, and set trigger device disengaged position.
Figure 48:
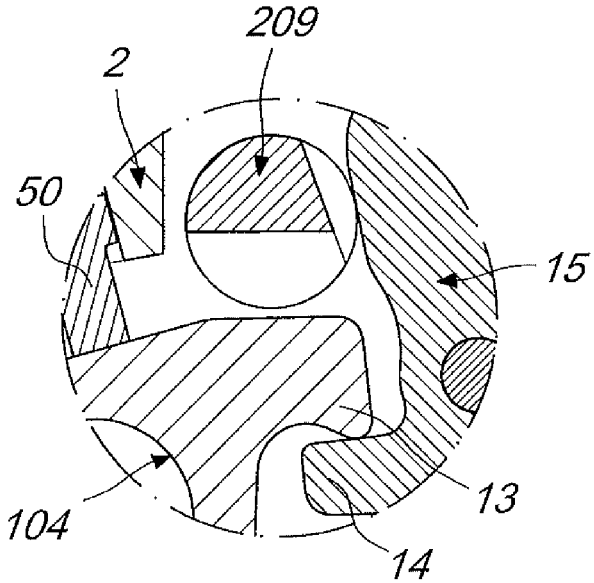
FIGS. 48-49 are enlarged views of details of FIG. 47.
Figure 49:
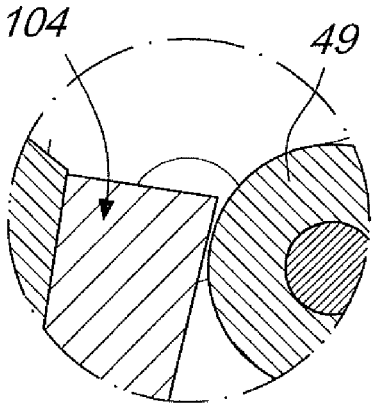

FIGS. 47-49 are views of the trigger unit in the firearm on fire position, with the trigger inactive and the set trigger device not engaged.

FIGS. 50-53 are views of the trigger unit in the firearm on fire position, with the trigger engaged and the set trigger device inserted.

FIGS. 54-57 are views of the trigger unit in the firearm on fire position, with the trigger floating and the set trigger device in action.

FIGS. 58-61 are views of the trigger unit in the firearm on fire position, with the firing pin floating, at the end of the action of the set trigger device.

The set trigger device is activated by rotating the trigger 104 forward, from the rest position, which is visible in FIG. 47, to the set trigger device engaged position visible in FIG. 50.

The movement of the trigger allows to load the set trigger device spring 45 and to store all the energy that is required to disengage the safety tooth 15.

By actuating the trigger, clearance is given to the trigger to release dynamically the stored energy.

By virtue of the particular configuration of the selector 209, 309, the set trigger device cannot be engaged when the safety is in the retracted position (firearm on safe).

In all the guard assembly configurations, the pusher pin 50 has the function of keeping the trigger 4, 104 in contact with the safety tooth 15, preventing free movements of the trigger.

The pusher pin 50 has also the function of deactivating the set trigger device if the user does not want to fire the shot, after rotating the trigger forward, in the set trigger device activated position, which is visible in FIG. 50.

The set trigger device can be deactivated in three ways: by operating the trigger, by translating the bolt, or by putting the firearm on safe.

By activating the trigger, consequent firing occurs.

The translation of the bolt causes the impact of the trigger against the trigger teeth, which are selected, i.e., rotated, and firing does not occur because the firing pin is retained by the bolt.

The deactivation of the set trigger device, by means of the translation of the bolt, is shown in FIGS. 66-80.

Figure 66:
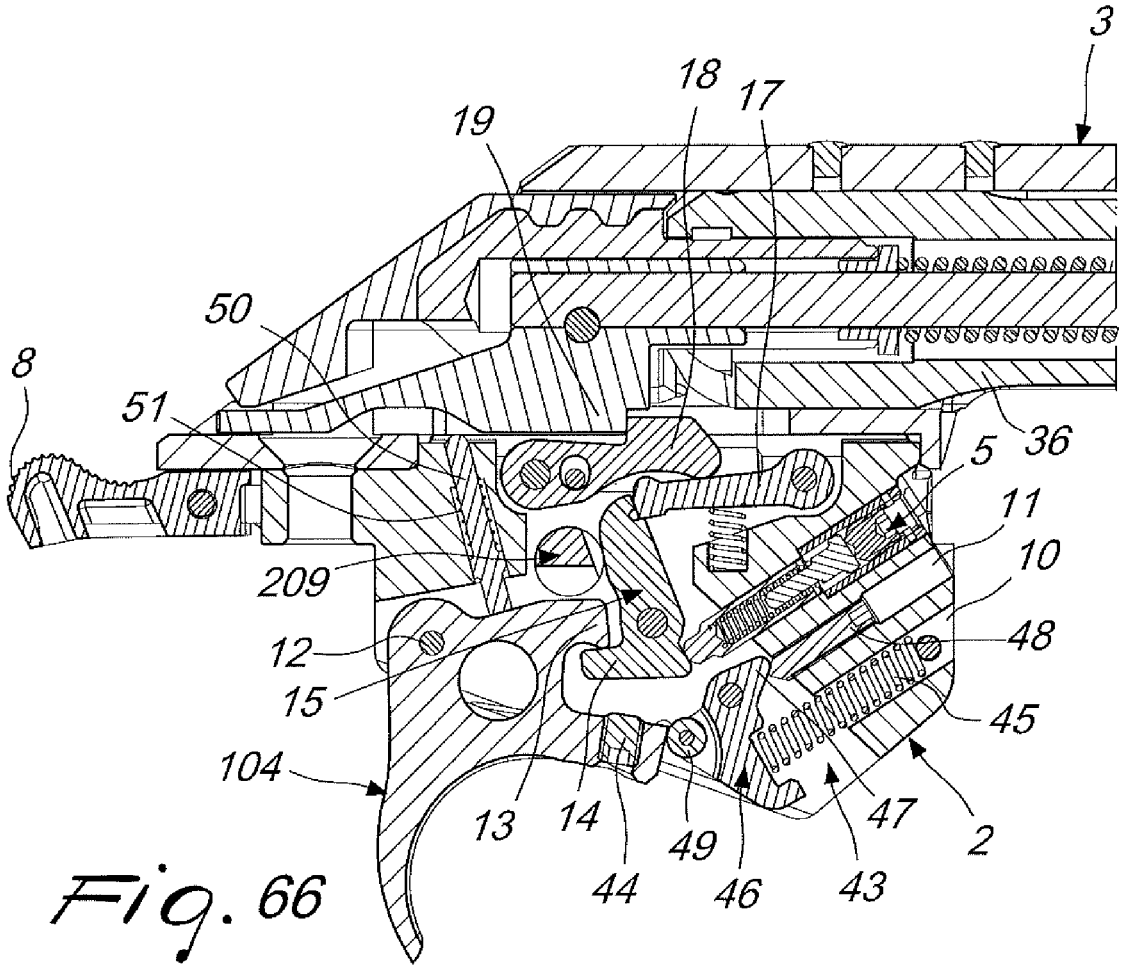
FIG. 66 is a section side view of the trigger unit and of part of the bolt and of the receiver of the firearm, in the configuration with set trigger device, shown in the firearm on fire, trigger at rest and set trigger device not engaged position.
Figure 67:
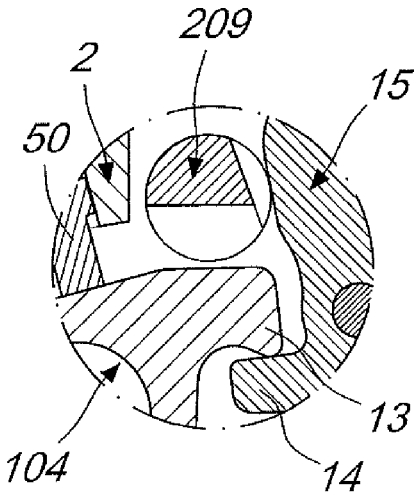
FIGS. 67-68 are enlarged views of details of FIG. 66.
Figure 68:
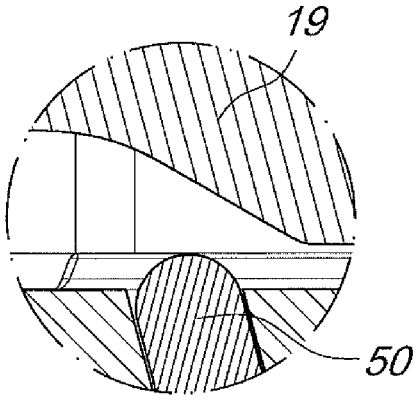
Figure 69:
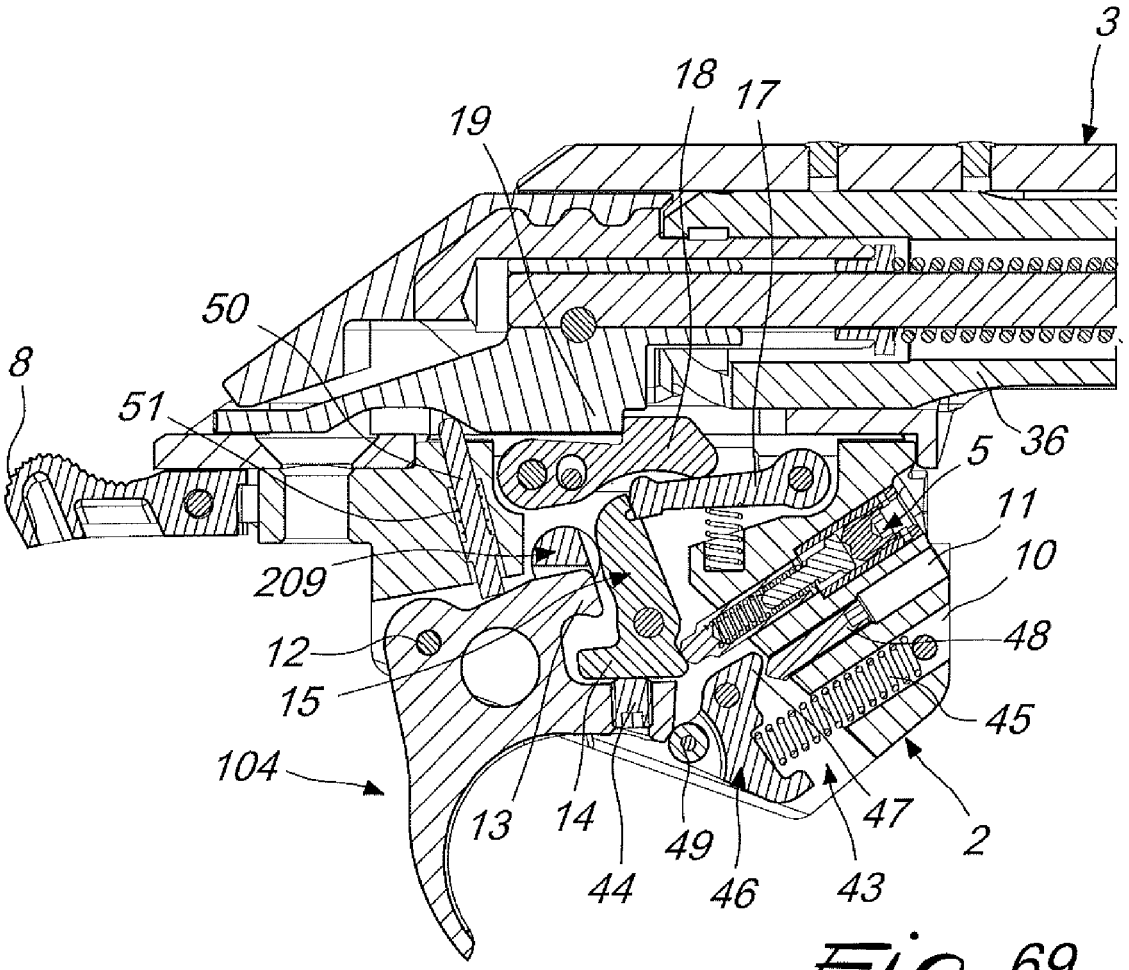
FIG. 69 is a section side view of the trigger unit and of part of the bolt and of the receiver of the firearm, in the configuration with set trigger device, shown in the firearm on fire, trigger engaged and set trigger device engaged position.
Figure 70:
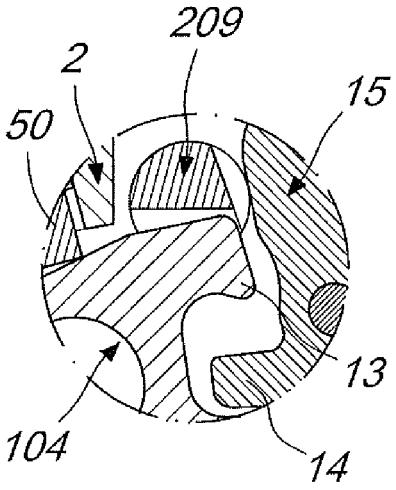
FIGS. 70-72 are enlarged views of details of FIG. 69.
Figure 71:
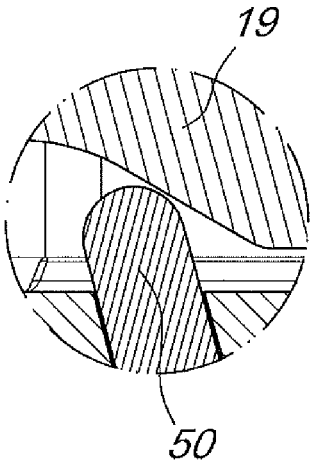
Figure 72:
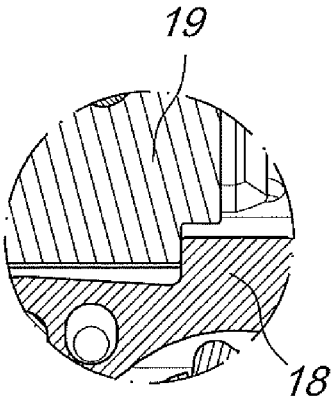
Figure 73:
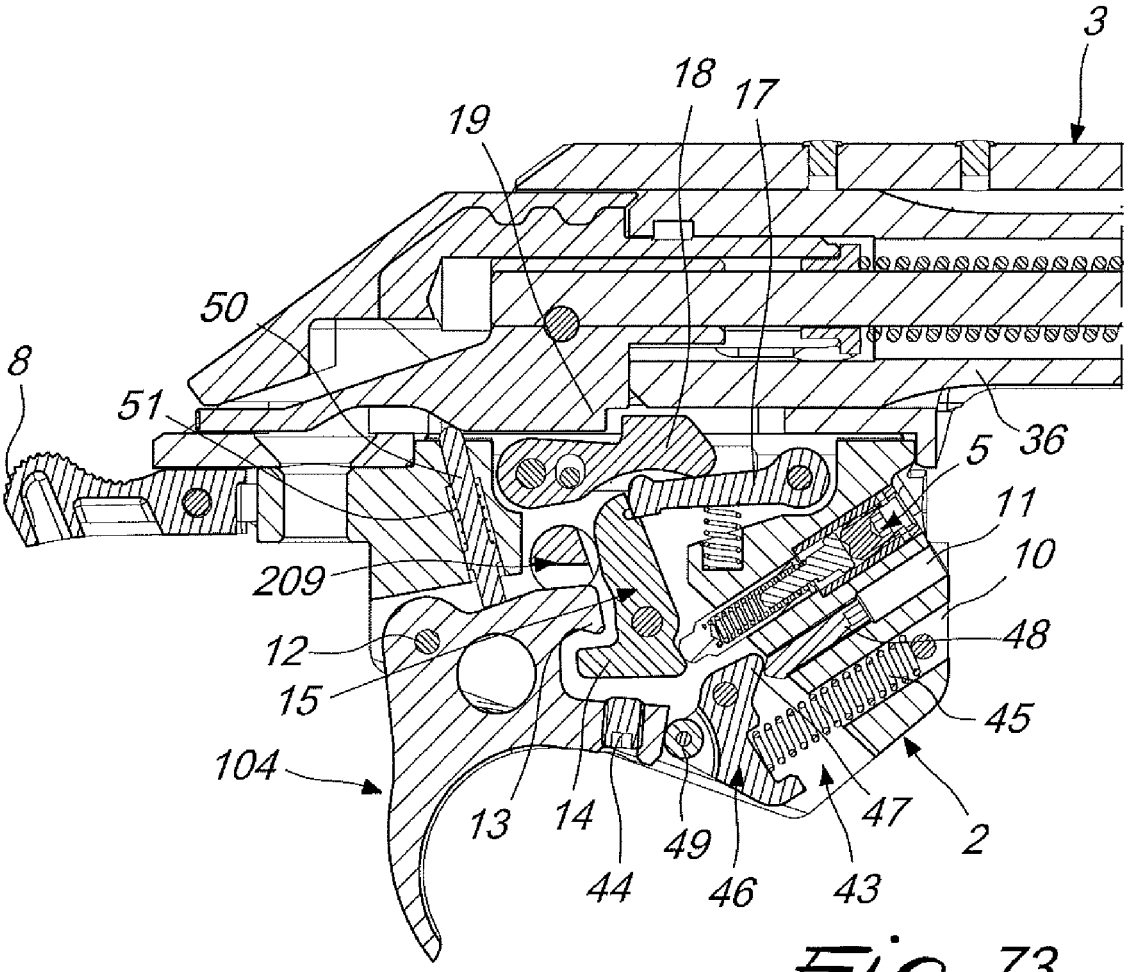
FIG. 73 is a section side view of the trigger assembly and of part of the bolt and of the receiver of the firearm, in the configuration with set trigger device, shown during the translation of the bolt with floating trigger and set trigger device in action.
Figure 74:
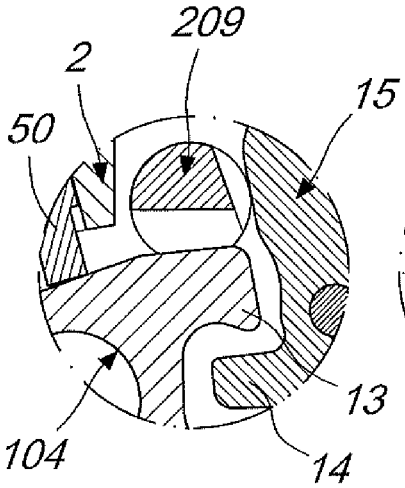
FIG. 74-76 are enlarged views of details of FIG. 73.
Figure 75:
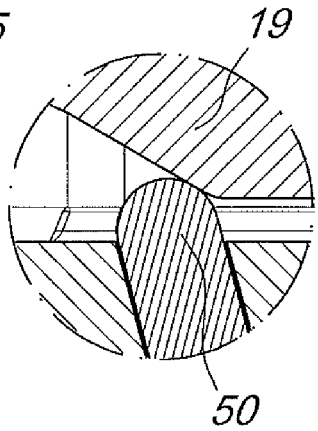
Figure 76:
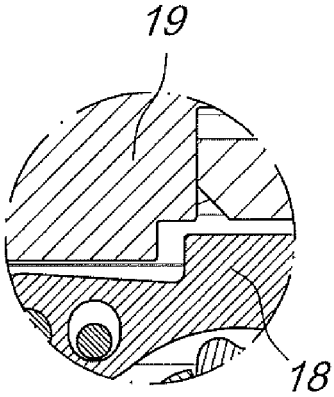
Figure 77:
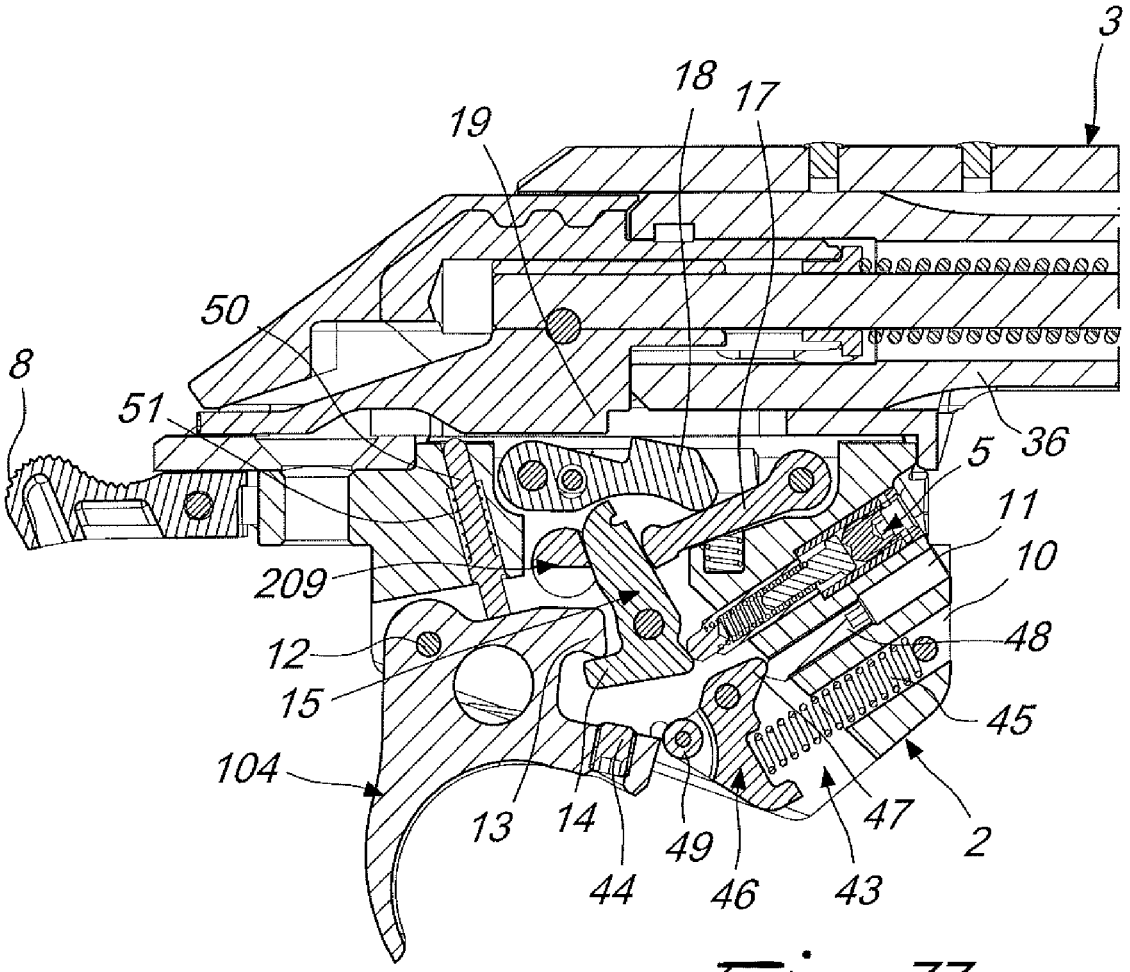
FIG. 77 is a section side view the trigger unit and of part of the bolt and of the receiver of the firearm, in the configuration with set trigger device, shown with the firing pin retained and the set trigger device at the end of its action.
Figure 78:
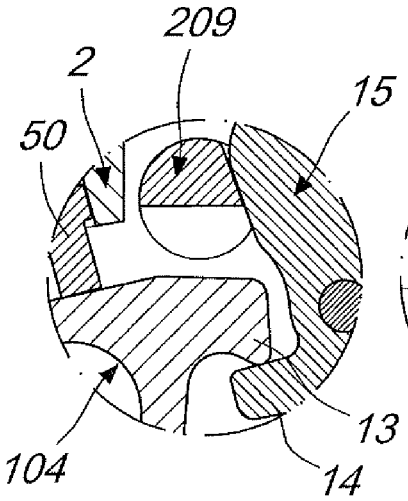
FIGS. 78-80 are enlarged views of details of FIG. 77.
Figure 79:
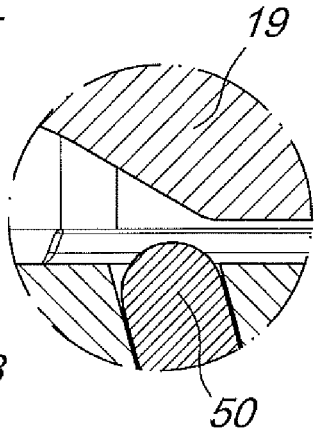
Figure 80:
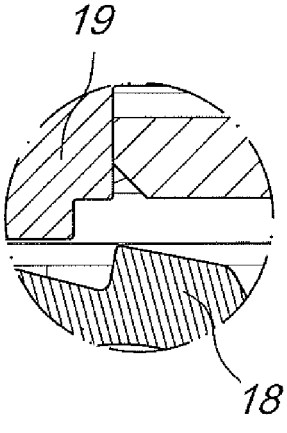

FIGS. 66-68 show the trigger unit in the firearm on fire position, with the trigger at rest and the set trigger device not engaged.

FIGS. 69-72 show the trigger unit in the firearm on fire position, with the trigger engaged and the set trigger device engaged.

FIGS. 73-76 show the trigger unit in the firearm on fire position, during the translation of the bolt with the trigger floating and the set trigger device in action.

FIGS. 77-80 are views of the trigger unit in the firearm on fire position, with the firing pin retained and the set trigger device at the end of its action.

By putting the firearm on safe, the system is designed to not fire: the trigger 104 in fact strikes the trigger teeth, which are preventively put on safe by the selector 209, 309, which prevents their rotation.

The deactivation of the set trigger device, putting the firearm on safe, is shown in FIGS. 81-95.

Figure 81:
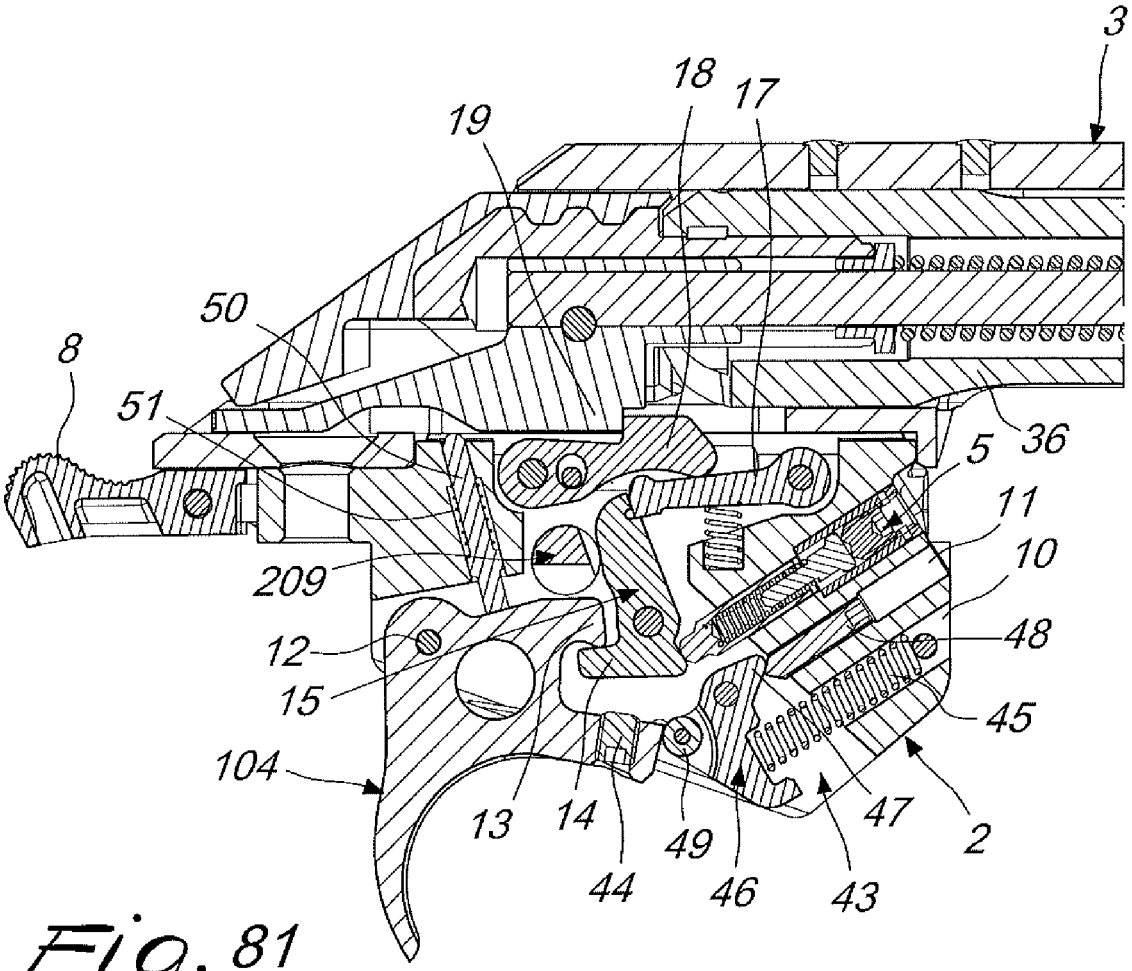
FIG. 81 is a section side view of the trigger unit and of part of the bolt and of the receiver of the firearm, in the configuration with set trigger device, shown in the firearm on fire, trigger at rest and the set trigger device not engaged position.
Figure 82:
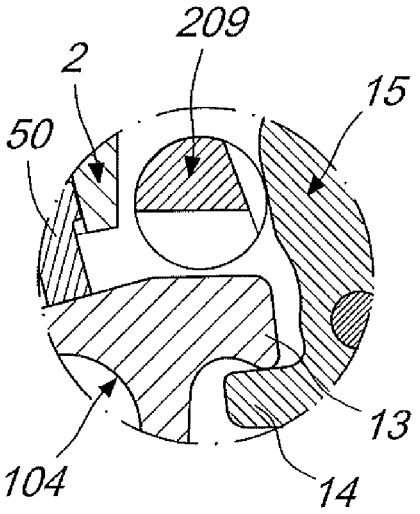
FIGS. 82-83 are enlarged views of details of FIG. 81.
Figure 83:
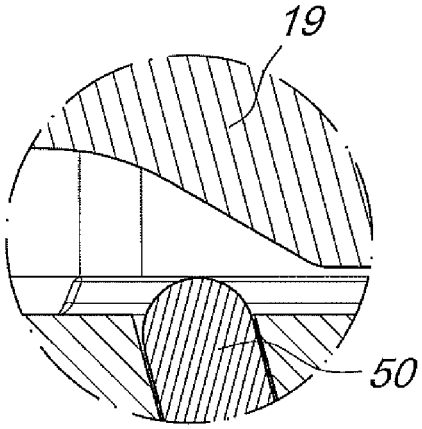
Figure 84:
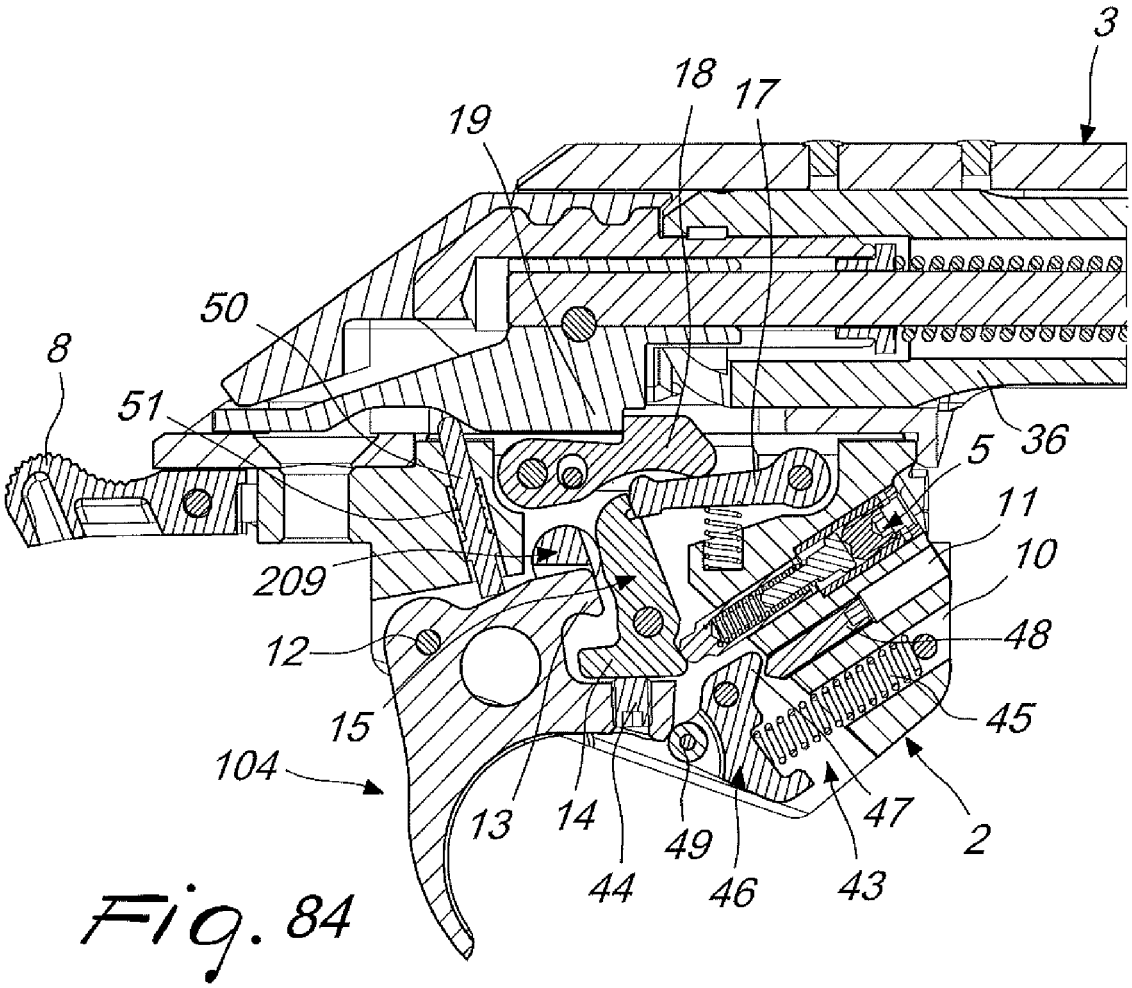
FIG. 84 is a section side view of the trigger unit and of part of the bolt and of the receiver of the firearm, in the configuration with set trigger device, shown in the firearm on fire, trigger engaged and set trigger device engaged position.
Figure 85:
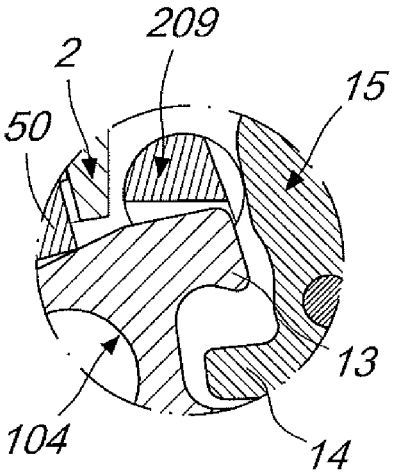
FIGS. 85-87 are enlarged views of details of FIG. 84.
Figure 86:
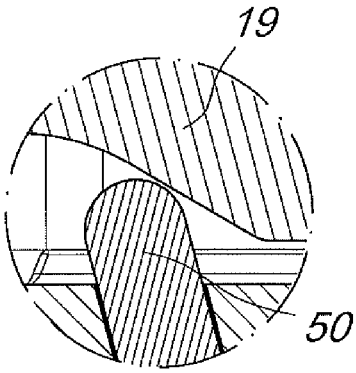
Figure 87:
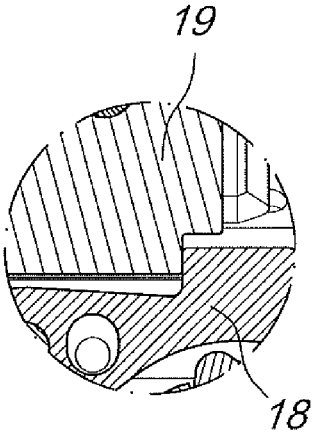
Figure 88:
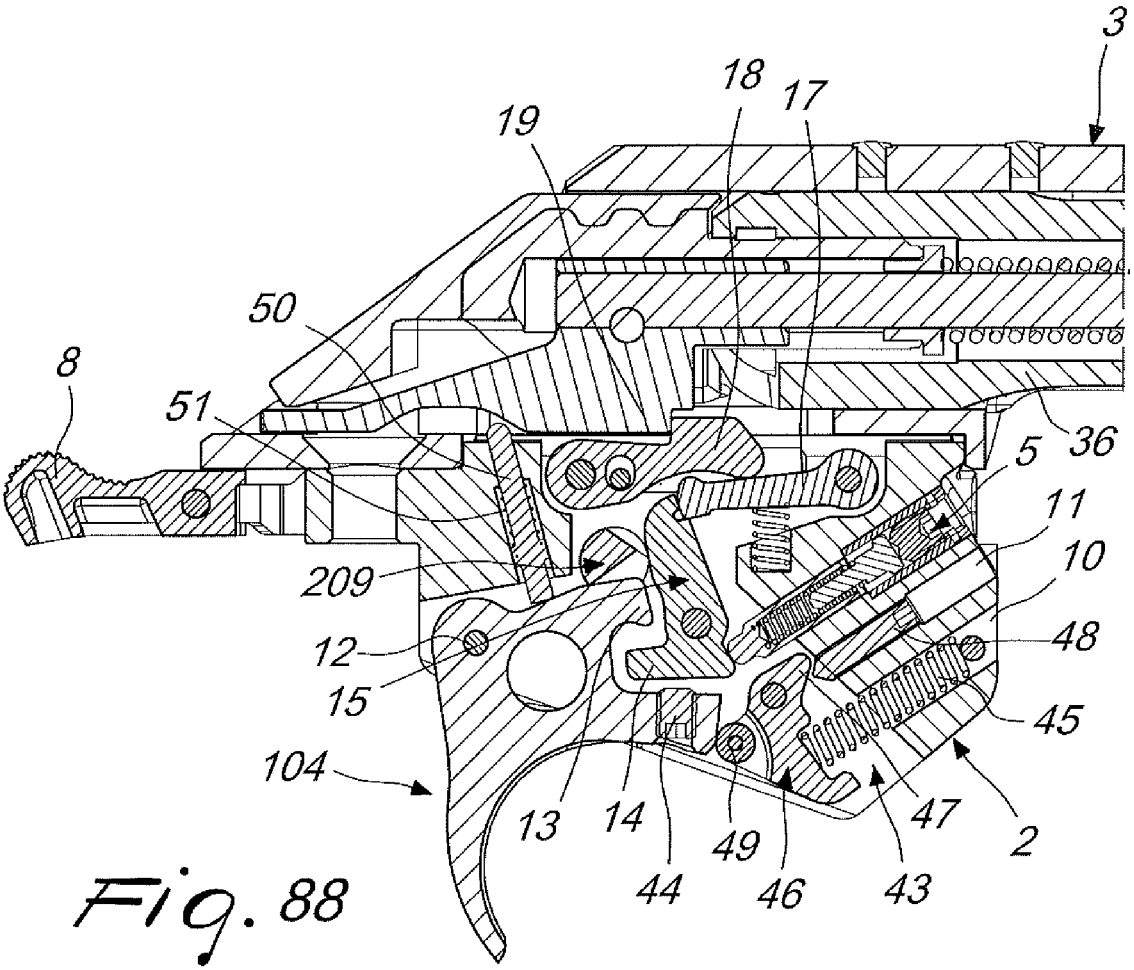
FIG. 88 is a section side view of the trigger unit and of part of the bolt and of the receiver of the firearm, in the configuration with set trigger device, shown during the translation of the safety.
Figure 89:
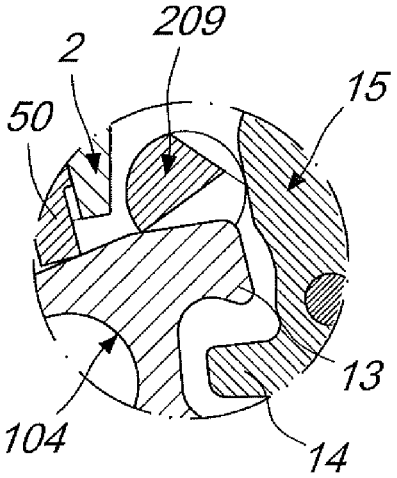
FIGS. 89-91 are enlarged views of details of FIG. 88.
Figure 90:
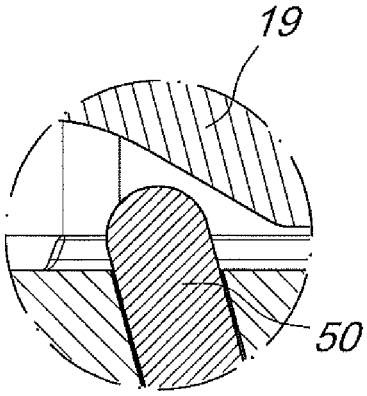
Figure 91:
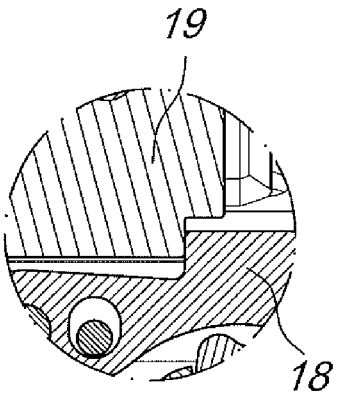
Figure 92:
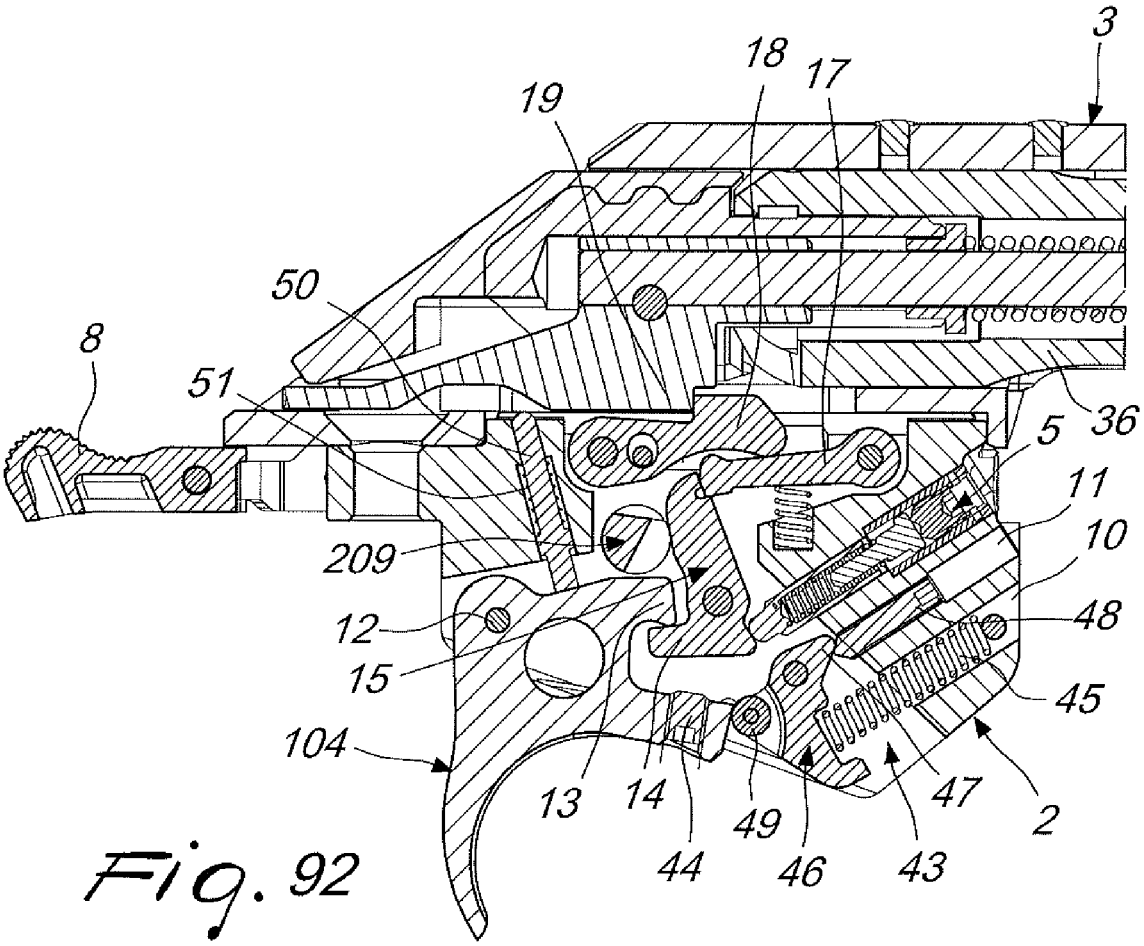
FIG. 92 is a section side view of the trigger unit and of parts of the bolt and of the receiver of the firearm, in the configuration with set trigger device, shown in the position in which the safety is engaged and the set trigger device is at the end of its action.
Figure 93:
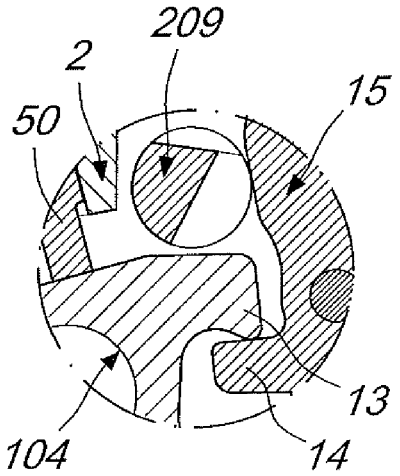
FIGS. 93-95 are enlarged views of details of FIG. 92.
Figure 94:
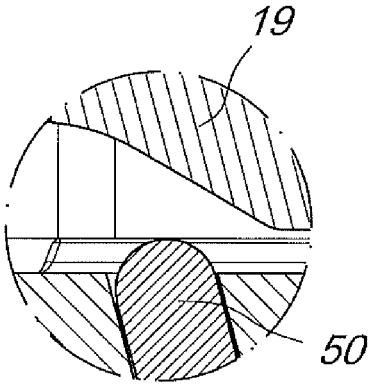
Figure 95:
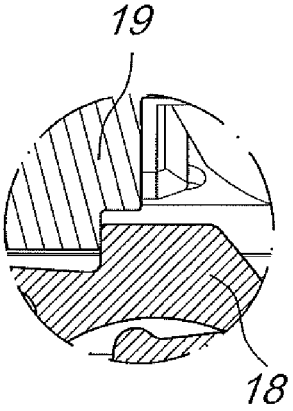

FIGS. 81-83 show the trigger unit in the firearm on fire position, with the trigger at rest and the set trigger device not engaged.

FIGS. 84-87 show the trigger unit in the firearm on fire position, with the trigger engaged and the set trigger device engaged.

FIGS. 88-91 show the trigger unit during the translation of the safety, which occurs by pulling (to the left with reference to the figure) the button 8.

FIGS. 92-95 show the trigger unit in the position with the safety inserted and with the set trigger device at the end of its action.

The trigger unit according to the present invention offers various functional and production advantages by virtue of its modular construction.

From a production standpoint, the trigger unit is built starting from a limited number of components which are common to all the various configurations.

In fact, to provide the various configurations and therefore in practice different trigger models with different functional characteristics it is sufficient to add some components to the basic structure.

An advantage, from the production standpoint, of the trigger unit according to the present invention, is the fact that the trigger unit is compatible both with a right-handed firearm and with a left-handed firearm.

A functional advantage of the trigger unit according to the present invention is constituted by the fact that it is provided with a safety having a translating central actuation, which is ambidextrous and can be selected easily by all users.

A further functional advantage of the trigger unit according to the present invention is that it allows an easy adjustment of the trigger pull weight, by the fact that the adjustment grub screw can be easily accessed simply by extracting the magazine, differently from common prior art systems wherein it is necessary to disassemble the barrel and the sight with the consequent needs to recalibrate the aim.

In practice that has been found that the invention achieves the intended aim and objects, providing a modular trigger unit that can be manufactured in various configurations in order to meet the various requirements of users.

The trigger unit according to the invention is susceptible of numerous modifications and variations, all of which are within the scope of the inventive concept; all the details may furthermore be replaced with technically equivalent components.

The materials used, as well as the dimensions, may of course be any according to the requirements and the state of the art.

This application claims the priority of Italian Patent Application No. 102019000007983, filed on Jun. 4, 2019, the subject matter of which is incorporated herein by reference.

The invention claimed is:

1. A trigger unit comprising a support adapted to be mounted on the receiver of a firearm comprising a bolt and a firing pin that is inserted in said bolt, said support supporting components of a trigger mechanism and of a safety system; said support comprising a plurality of seats adapted to accommodate one or more different functional components, wherein said components of said trigger mechanism comprise a trigger, which is hinged to said support and has a protrusion adapted to interact with a lower protrusion of a safety tooth that is hinged to said support;

said safety tooth includes an upper end;

said upper end is in contact with a selector and engaging a reducer that is hinged to said support;

said reducer acts on a firing pin hook tooth; and said firing pin hook tooth directly interacts with a firing pin of said firearm.

2. The trigger unit according to claim 1, wherein said functional components comprise a trigger pull weight adjustment device.

3. The trigger unit according to claim 1, wherein said functional components comprise a set trigger device.

4. The trigger unit according to claim 1, wherein said selector comprises a cylindrical body having an end that is integral with a drum, and a free end; said cylindrical body being inserted in said support and having a free end that is opposite to said end that is integral with said drum and has a locking member; said drum being shaped as the letter V, in the vertex of which one end of a safety selection lever is hinged, said safety selection lever providing a clear selection of said safety system from a safety position to a firing position of said firearm and vice versa; said cylindrical body safing the firearm and preventing a rotary movement of said safety tooth, preventing the selection of said trigger mechanism from said safety position to said firing position; said cylindrical body having a flattened region which, in said firing position of the firearm, allows the rotation of said safety tooth when said trigger is activated.

5. The trigger unit according to claim 4, wherein said cylindrical body has a recessed portion at said drum which is adapted to hold an O-ring that has the function of reducing the selection noise of said safety system.

6. The trigger unit according to claim 4, wherein said safety system comprises a button that is connected to a plate; said plate acting on said selector by means of a pin that is hinged in said drum of the selector and is engaged by a cam of said plate; the rotation of said drum causing a movement of said safety selection lever that is hinged to said drum; said safety selection lever having a free end that acts on said trigger mechanism.

7. The trigger unit according to claim 4, comprising a system for locking the bolt of said firearm; said bolt locking system comprising a bolt locking plate that is hinged to said support and having a tab that interferes with the movement of said bolt, preventing the rotation of said bolt in said safety position; said selector comprising a notch formed in said cylindrical body in a position adjacent to an annular recess of the free end of said cylindrical body; said notch preventing an upward rotation of said bolt locking plate when, by means of said button and said plate, said selector is rotated in order to safe the firearm; in said firing position said bolt locking plate being lowered and its tab not interfering with said bolt, allowing its rotation.

8. The trigger unit according to claim 4, wherein said functional components comprise a set trigger device; said components of said trigger mechanism comprising a trigger; said trigger comprising a grub screw that allows to adjust the position of said trigger that is rotated forward with respect to said lower protrusion of said safety tooth in said firing position; said set trigger device comprising a set trigger spring that is inserted in one of said seats of said support and acts on an anchor member that is hinged on said support; said anchor member having a first end that abuts against the end of an adjustment screw that is inserted in a threaded seat of one of said seats of said support, and a second end that is provided with a roller adapted to interact with a lower part of said trigger.

9. The trigger unit according to claim 8, comprising a pusher pin which is provided with a coil spring, is inserted in a seat of said support and holds said trigger in contact with said safety tooth.

10. The trigger unit according to claim 8, wherein said cylindrical body has a flattened region which, in said firing position of the firearm, allows the rotation of said safety tooth when said trigger is activated; said selector having a set trigger notch formed at said flattened region of said cylindrical body; said set trigger notch allowing the selection of said trigger in order to activate said set trigger device.

11. The trigger unit according to claim 1, comprising a trigger pull weight adjustment system; said trigger pull weight adjustment system comprising a trigger pull weight adjustment device inserted in a seat formed in said support; said pull weight being generated by a spring that is mounted coaxially to a spring guide pin on which a grub screw acts; said grub screw being surrounded by a securing insert that is associated with a threaded sleeve.

* * * * *